US006024685A

United States Patent [19]

Kirsch

[11] Patent Number: 6,024,685

[45] Date of Patent: Feb. 15, 2000

[54] RUNNER FOR A CREASER AND CREASER

[75] Inventor: Klaus Kirsch, Grafenberg, Germany

[73] Assignee: Winkler +Dunnebier Maschinenfabrik und Eisengiesserei KG, Neuwied, Germany

[21] Appl. No.: 08/609,662

[22] Filed: Mar. 1, 1996

[30] Foreign Application Priority Data

Mar. 3, 1995 [DE] Germany ..... 195 07 351

[51] Int. Cl.[7] ..... B41F 13/56

[52] U.S. Cl. ..... 493/396

[58] Field of Search ..... 493/356, 359, 493/370, 425–433, 471, 475, 476, 357; 270/49, 50

[56] References Cited

U.S. PATENT DOCUMENTS

| | | | |
|---|---|---|---|
| 2,353,445 | 7/1944 | Crafts | 493/429 X |
| 2,435,881 | 2/1948 | Faeber | 493/429 X |
| 2,463,769 | 3/1949 | Higgins | 493/426 X |
| 2,941,798 | 6/1960 | Harless | 493/429 X |
| 3,338,575 | 8/1967 | Nystrand et al. . | |
| 3,689,061 | 9/1972 | Nystrand | 493/429 X |
| 3,870,292 | 3/1975 | Bradley . | |
| 4,159,823 | 7/1979 | Bryer et al. | 493/425 X |
| 4,273,320 | 6/1981 | Fujishiro | 493/427 |
| 4,475,730 | 10/1984 | Trogan | 270/41 |
| 4,519,597 | 5/1985 | De Santo . | |
| 4,521,209 | 6/1985 | Dufresne | 493/432 |
| 4,820,249 | 4/1989 | Wech | 493/475 X |
| 4,921,235 | 5/1990 | Biagiotti et al. . | |
| 5,147,273 | 9/1992 | Rottmann et al. | 493/433 X |
| 5,522,586 | 6/1996 | Bennett et al. | 493/429 X |

FOREIGN PATENT DOCUMENTS

| | | |
|---|---|---|
| 0257390A1 | 8/1987 | European Pat. Off. . |
| 2 508 880 | 1/1983 | France . |
| 649 113 | 8/1937 | Germany . |
| 1436506 | 11/1968 | Germany . |
| 2120903 | 1/1972 | Germany . |
| 2123243 | 11/1972 | Germany . |
| 95399 | 2/1973 | Germany . |
| 2644232 | 4/1977 | Germany . |
| 3406264A1 | 11/1984 | Germany . |
| 9017695 | 12/1991 | Germany . |
| 9205154 | 6/1992 | Germany . |
| 4407375A1 | 9/1995 | Germany . |
| 1515349 | 6/1978 | United Kingdom . |
| 2 050 317A | 1/1981 | United Kingdom . |

*Primary Examiner*—David A. Scherbel
*Assistant Examiner*—Anthony Ojini
*Attorney, Agent, or Firm*—Akin, Gump, Strauss, Hauer & Feld, L.L.P.

[57] ABSTRACT

A rotor (10, 11) of a creaser (1) including contact means (30, 27) to secure the web of the material to be creased (5 to 7), drawing it radially against its circumference, the positive contact pressures of which are adjustable over the pass and the working width and the position of which in relation to the rotor means and/or any tools (22, 23 and/or 26) provided on the same is variable, thus allowing a multitude of adaptations to the creasing unit (8) to be provided. Control may be effected mechanically by gears and/or adjusting baffles for the vacuum.

32 Claims, 10 Drawing Sheets

RUNNER FOR A CREASER AND CREASER

Figure 1:
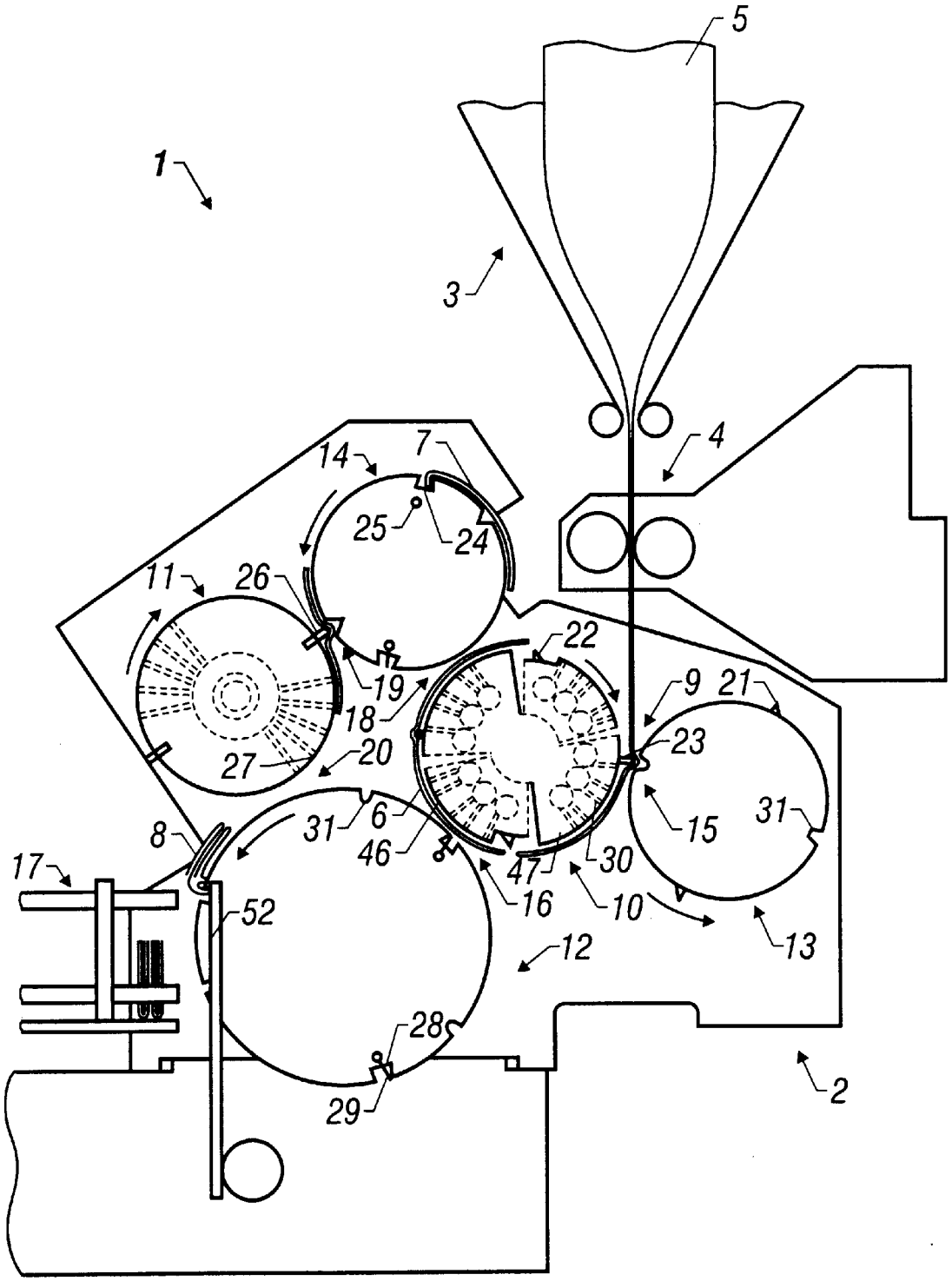

The invention refers to a rotor and/or a creaser equipped with the same by which a flat material such as paper, tissue, non-wovens or similar can be folded once or several times and/or in reciprocal cross directions in order to create a folded unit from a flexible or pliable and initially horizontally spread blank, such as a cleaning tissue, a duster, a cleaning rag, a kitchen towel, a napkin or similar.

According to the invention, a web layer is initially taken off from a storage roll in a conveying and/or longitudinal direction essentially continuously and is processed possibly after previous single or multiple longitudinal creasing by passing over one or several operational runners or rotors of the said type. Initially separate sequential blanks are severed from the front end of the web by cross cuts, followed by being cross-creased one or more times whilst alternately passing over rotors, followed by being delivered in a horizontal or upright stack formation to a deposit. Although this is conceivable, processing of the blanks should be preferably performed without perforations through the sheet layer and/or front and/or side edge trimming after longitudinal and/or cross creasing, but with the said passage including levelling, printing with a design and/or full surface and/or edge embossing of the web prior to creasing, followed by cross cutting into two or more working webs and/or blanks, simultaneously running next to each other, to be processed whilst passing over the same operational rotors in a juxtaposed orientation.

The unit may be creased by longitudinal creasers into a V, M, N and/or C-configurations, with the folded legs, such as those of cross creases, being of the same or different lengths and with these lengths and those of a finished creased unit being adjustable during operation. Transfer and/or processing over each rotor may also be effected without creasing.

The individual rotor, such as a rotary and/or roller rotor, includes support faces extending in working direction for receiving the sheet layers and holding or contact means for fixing the leading front end of the sheet and the sheet web and/or individual sheet layers. Instead of the said perforating means or contact means which only grip or clamp the narrow edge or creasing areas, and/or in addition to these, contact means are provided which essentially are exerting such a tight grip that a tension applied to the material will allow its sliding displacement on the reception or contact face without the material tearing in cross direction to the tension. Such contact means may consist of adhesive and/or vacuum means, also pressing the material with a minimum edge clearance of 1 cm, based on a predetermined contact pressure, against the contact face.

These contact means have functional characteristics, i.e. a predetermined static and/or sliding friction between the contact face and the material, several locations of contact areas in relation to the rotor body, intermediate spacings in relation to the rotor means between separate contact areas and/or extensions of each contact area in the working direction and in a cross direction transverse to the working direction, a relation of the area-specific holding forces or contact pressures of at least two contact areas, absolute contact pressures above zero in the contact areas and contact pressures depending on the distance of each contact area from a reference base non-mobile with respect to the operating and/or working direction or from a fixed reference point non-mobile in relation to the machine base.

If the contact means, as in the case of a suction perforation, act at points nearly uniformly distributed in a close grid formation, the said contact areas may be preferably regarded as an area including a few up to a multitude of such points, with the contact area also being understood as part of a larger contact area to which essentially constant contact pressures are applied.

Rotors including contact means of the described type are showing different operating functions over their repeated working path, i.e. when subjecting the web to a predetermined tension, generating side guiding forces, allowing slip-free contact and contact including slipping of the material, handing over the material possibly while creasing, preventing displacement of the fold legs within the creased units, allowing cross cuts, permitting size changes of the material respective the creased units, etc. It has proved to be difficult to design the working surface or the contact means in such a way that these will meet several of these requirements.

An object of the invention is furthermore to provide a runner and/or a creaser in which disadvantages of prior art constructions or of the described type are avoided and which allow in particular adaptation of the functional characteristics of the rotor to given requirements.

Each runner or rotor may be equipped with arrangements and/or tools for different processings, for instance with one or several cross cutters, counter cutters, internal creasers, external creasers, transfer means for transfer of the blank from one rotor and/or one working station to the next and/or with other arrangements, with the said contact means not being provided. The rotor may be compulsorily and synchronously controlled by suitable gears i.e. double planetary gears in relation to one or several other rotors, or be driven in relation to this other rotor by a rectified phase displacement or shifting in order to effect a change in size of a specific folding leg respective the entire unit or similar. Such gears and similar adjusting devices are suitable to change each functional characteristic even during operation of the rotor, allowing a change-over to differently creased or similar units whilst the creaser is in operation.

Control and/or adjusting means will furthermore allow that the positive contact pressures of the rotor-stationary contact areas will change as a function of the operating motion, for instance for specifically strongly and therefore side-guidingly securing the front end of the web prior to severing the blank, for then reducing the contact pressures after cross-cutting and substantially up to a positional securing on a next rotor provided for taking over the material unit and for providing again reduced or even cancelled contact pressures for that leg of the blank which is torn off against working direction from the rotor and its support face. Furthermore, the effect may be that during bulging of the material, for instance due to a creasing rail, contact pressures are briefly and partially released from the material leg trailing the bulging zone, in order to pull it behind, whereafter immediately increasing the contact pressure may take place prior to and/or while processing a cross-cut, entirely severing the said material leg. This may eliminate oblique pulling of the material during this processing cycle.

As soon as each contact area, controlled as described, again reaches the material following the first, the said high contact pressures or the like are generated. Consequently contact areas of different and/or constant positive contact pressures result which in relation to the reference base follow each other in the working direction.

According to the invention, at least one of the functional characteristics is variable, whereby the said adjustment can be effected by conversion and/or change of parts and/or by a setting means, allowing resetting merely by adjustment and without any assembly work.

Furthermore, the distance of each contact area from the reference base and/or its extension in relation to the reference base and/or the rotor, is preferably adjustable, allowing the material to be secured at random sections and over random areas transverse and/or parallel to the working direction depending on requirements, by applying identical or different positive contact pressures.

In operation, the rotor is acting in the vicinity of working areas, arranged adjacent to each other in working direction and/or in a direction transverse thereto, the working areas effecting motions of at least part of the material transverse to the support face and/or effecting material machining and in most cases representing working stations in which the support area of the rotor is in engagement with the support area of a counter runner or rotor. In order to determine and/or vary the said contact pressures along the path between such adjacent working zones or at these working zones, which are positionally substantially fixed in relation to the reference base it is preferable to arrange at least one control element which, in the case of a web-securing unit based on fluid pressure, may be designed as an adjustable baffle, a control valve or the like. Its control and/or baffle port may be arranged entirely on the side outside the working width and/or entirely inside the working width of the rotor.

Irrespective of the described embodiments, the invention may also include means to differently select and/or change at least one of the functional characteristics in zones juxtaposed transverse to the working direction, in particular to adjust them reciprocally to each other or independently from each other. The contact pressures of such areas may, for instance, can be selected at varying levels, whereby positive pressures and/or contact pressures around zero can be generated in at least two contact areas. Should the material have at least one crease in a direction parallel to working direction, such as a longitudinal crease and/or should the material be positioned on the support face in at least a double layer including material legs superimposed on each other, it would be of advantage to apply a higher contact pressure to the area of the free end of the material leg located away from the support face than to the opposite parallel edge area of the material in order to prevent reciprocal shifting displacement of the material layers and consequently a change in position of a crease or the like.

Variability of each functional characteristic may also be effected by reciprocal positional adjustment of runner and/or reception bodies or of sections of the support faces in working direction and/or transverse thereto whereby the named arrangements, holding zones and/or tools can be adjusted in position in relation to the rotor and/or in their spacing from each other. The rotor preferably consists of two or more individual bodies which may be displaced in relation to each other by an adjusting means or by conversion of the rotor while the rotor is remaining in its support, the machine base or its drive coupled state. This will allow variation of reciprocal tool spacings, of spacings between adjacent contact areas and/or of sizes respective areal extensions of such contact areas in order to set different blank sizes. Both individual bodies forming separate contact areas.

With respect to their extension parallel to the working or operating direction and/or transverse thereto the support faces and/or contact areas may be formed partially and/or essentially completely, by components designed separately from the associated rotor body and attached to its working side, in particular in a way to be exchangeable without distruction. Such a component, which would best be designed and/or be attached separately from the tool closest to it, may be a cover for one or two adjacent rotor segments which are reciprocally displaceable parallel to the working direction and/or for a gap provided between opposing flanks of these segments and variable in width. This gap may form a pressure and/or vacuum chamber radially extending nearly up to an internal shaft, which chamber is closed towards the support face by the said component, possibly with the exception of pressure respective suction ports. The respective component should preferably extend nearly to a region of the rotor body, which is offset transverse with respect to the support face and/or to the flank of the body. This transversely offset area may be a reception recess for a tool or a tool itself projecting over the outside of the body, with the back face of the tool in the first case providing a nearly gap-free continuation of the associated section of the support face or contact area up to the working area and/or the working edge of the tool.

If two components, attached for instance substantially rigidly to separate rotor segments and curved around a single axis only, engage each other in each reciprocal variable positioning, the respective section of the support face will always be formed by these two covering or sleeve segments. Instead of a conceivable serrated mutual engagement of the covering segments, it would be of advantage if the covering segment, which is shorter in operating direction, partially underengages the other covering segment with a projecting section in a direction facing away from the associated tool, with the associated section of the support face thereby including a small step. The height of this step may be kept very small and/or below 3 or 2 mm and may form a flowing or smooth transition due to the very thin design of at least the external covering segment respective due to tapering the overlapping transverse edge. It is of advantage that the individual rotor segment includes one or more covering segments having ends projecting in opposite directions, both these ends overlapping in the described way, further covering segments which are attached to further separate rotor segments arranged on both sides of the first named rotor segment. One of the said segment ends projects over the associated flank of its rotor segment in order to bridge the gap whilst the other end, in particular that directed against operating direction, ends with the other flank of its rotor segment, with the gap connecting to this flank being covered by a covering segment of the juxtaposed rotor segment.

One to all of the said covering segments may form holding areas and may be designed as a perforated sheet, for instance, the perforations of which are directly connected to chamber-shaped main ducts of the respective rotor body respective the fluid chamber formed by the gap. The main duct may therefore be designed as pockets and/or axial groove-shaped recesses in the external circumference and/or at least one flank of the respective rotor segment, directly closed by the covering segment and/or a separate closing unit on the open longitudinal groove side. The covering segment will then only be supported against longitudinal edges of axial or similar webs of the rotor segment, separating the adjacent main ducts and/or one main duct from the adjacent external flank of the rotor segment and directly extending from the hub of the rotor segment. The main ducts may be of very large and/or larger volume in comparison with the remaining rotor segment, thus reducing pressure variations at inlet ports and/or in the ducts. The very short branch ducts of the same width as the respective inlet port within each covering segment will also reduce friction losses in the flow, with the width of each branch duct possibly being larger than its length. The manufacture of inlet ports and/or very smooth support faces has been much simplified, and the grid distribution of inlet ports may be modified by exchanging the respective cover segment. The respective rotor segment may be manufactured as a finished or diecasting, with the main ducts and/or lateral connecting ducts being integral parts of the casting, not requiring any further machining of their internal surfaces.

Irrespective of the embodiment described, the invention also includes at least one rotor body which on one or both end faces is made in one part with a front flange extending nearly to its external circumference and/or with a respective bearing journal extending over a larger area of its working width, designed as an integral part of the casting, with the front flange possibly forming a control disk of the inlet control and/or closing the adjoining main ducts at the respective end. Such a one-part annular flange may be arranged between adjacent operating width sections and can separate main ducts juxtaposed along the working width. In addition, the rotor body formed in this way, in particular between two adjacent annular flanges, may form reception pockets for the rotor segments of the other rotor body which in a direction transverse to the support face extend continuously, which also are supported between the flanges on both sides free from axial motion play, and which are firmly connected to the respective control shaft or the like on the inside remote from the reception face of the first rotor body.

It is of advantage to support at least two of the individual bodies on at least one side of the working width separately and directly on the machine base respective to provide them with separate drive inputs, resulting in a very high stability, allowing, just like the other embodiments described, a great improvement in output during machining without any undesired vibration. Furthermore, the two individual rotors may be adjusted in relation to each other and driven synchronously by phase displacement of their power input at any time during operation.

Irrespective of the embodiment described, the rotor may be designed for selective reception respective processing of material of a different number of layers or creases without any conversion of the rotor itself. The rotor may take over, for instance, material by forming a first cross crease and a second cross crease. Should separate work stations be arranged for this purpose one behind the other in working direction of the rotor, the material may optionally be transferred to the rotor at one work station or another work station where the material has been previously given its first crease.

In the latter case, the material may nevertheless pass the first said work station, but without being taken over by the rotor, without any conversion or change in the passage section of this work station being necessary. This allows very easy adaptation of the creaser to the production of a different number of longitudinal and cross creases, with at least one of the adjusting means being suitable for optional start-up of each work station.

The adjusting means may also be optionally used for actuating and deactivating of at least one rotor, used for applying one of the said creases. Deactivating will prevent a further crease being otherwise made, which again will be makable by activating. It is, however, conceivable to therefore disengage the respective rotor from the drive mechanism, arranged in a pre-set position with respect to its operating movement and/or position, without dismantling the remainder of the equipment to remove it from its position or similar. It is, however, advisable that other components of the machine are transferred together with the rotor in the deactivated position, whereby these components can include one or several other rotors, their respective bearings, parts of the frame for rigidly supporting these and the like, which are adjustable as an entity between at least two of the said positions and/or are removable from the remainder of the creaser as a creasing module provided for making a crease.

These and other features are apparent from the claims, the specification and drawings, whereby individual features alone or together with others can be realized by sub-assemblies in an embodiment of the invention and other constructional fields and can constitute advantageous embodiments which are patentable as such, for which protection is claimed:

Embodiments of the invention are shown in the drawings and will be described in detail hereafter.

In the Drawings

Figure 2:
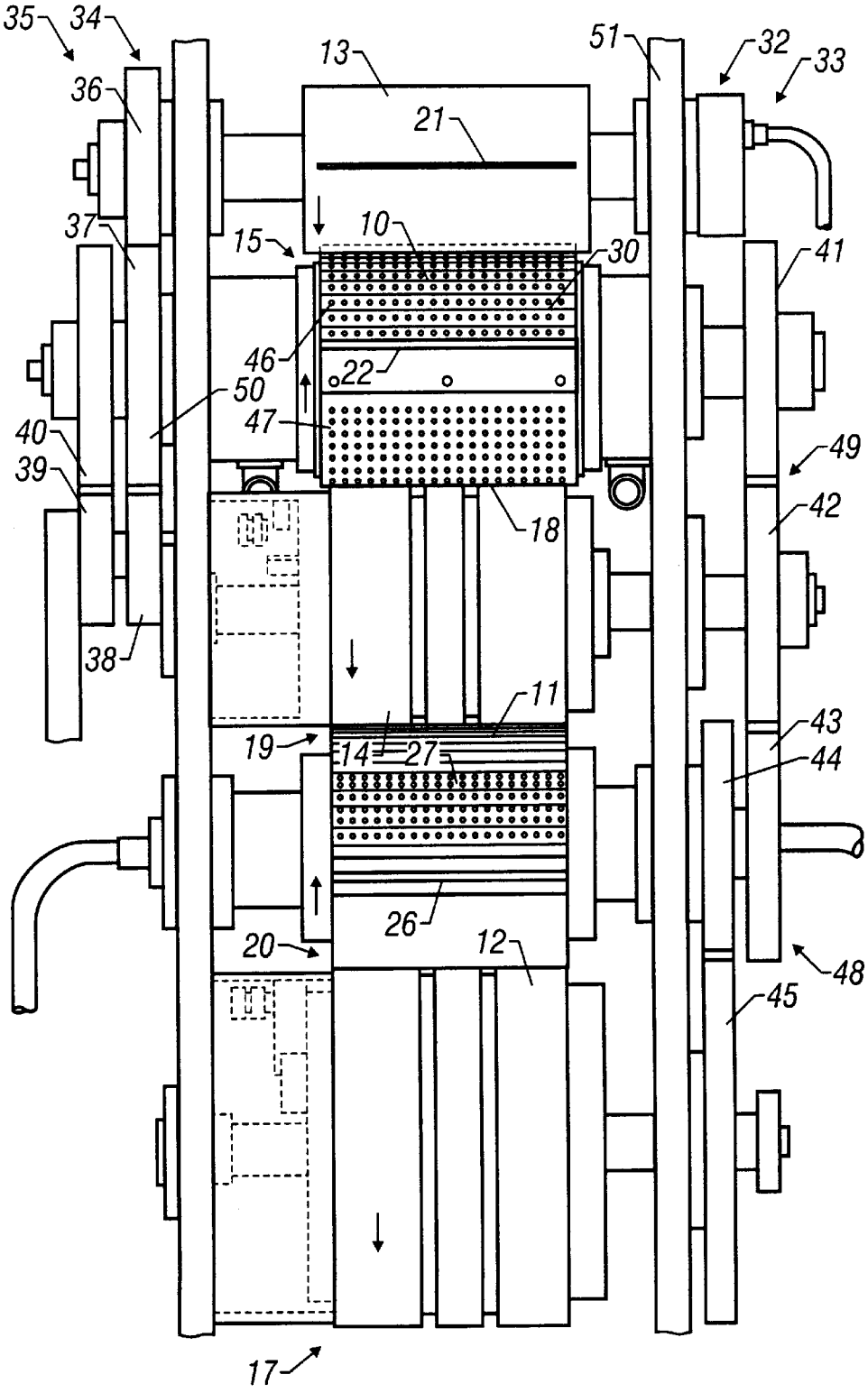
Figure 3:
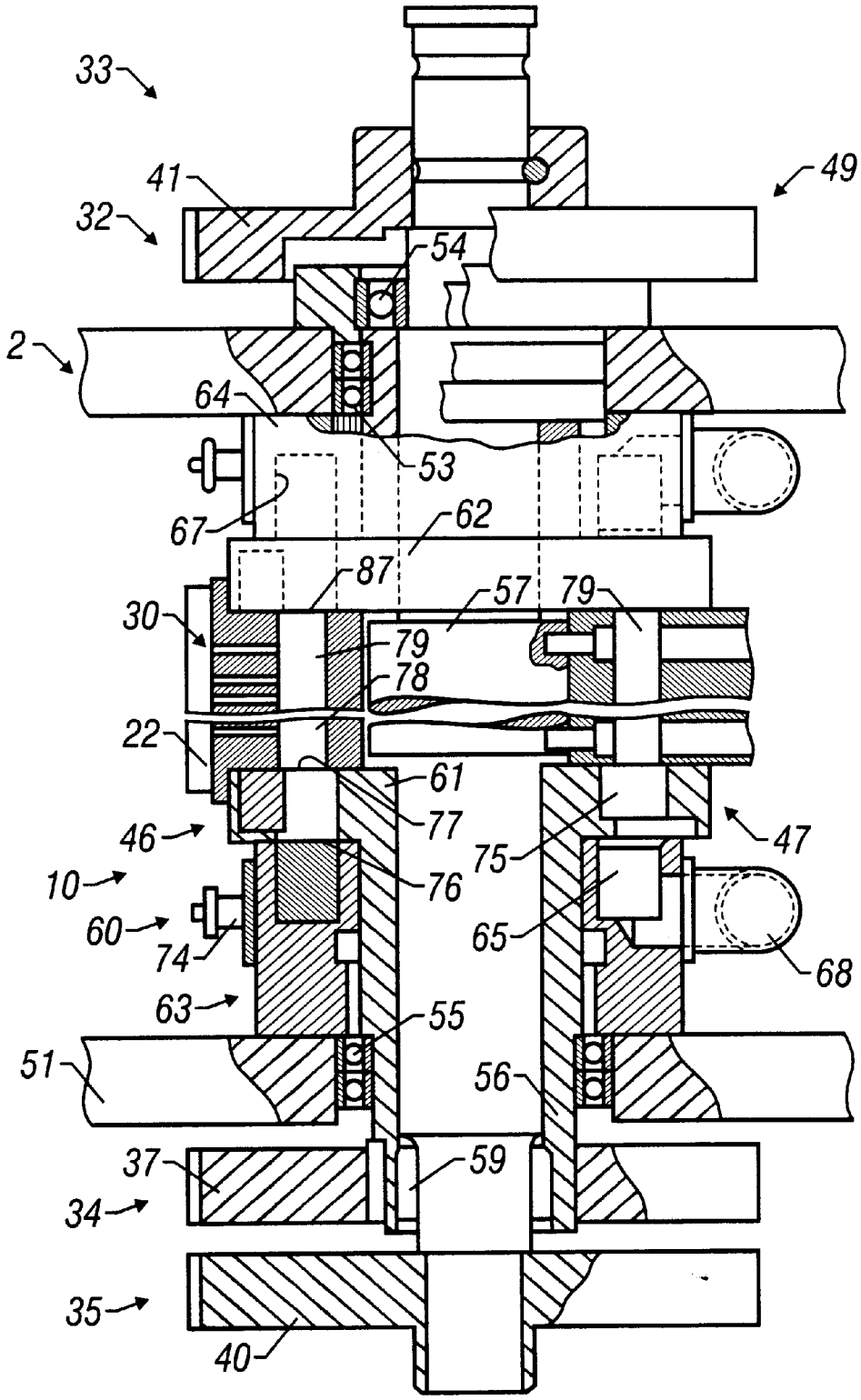
Figure 4:
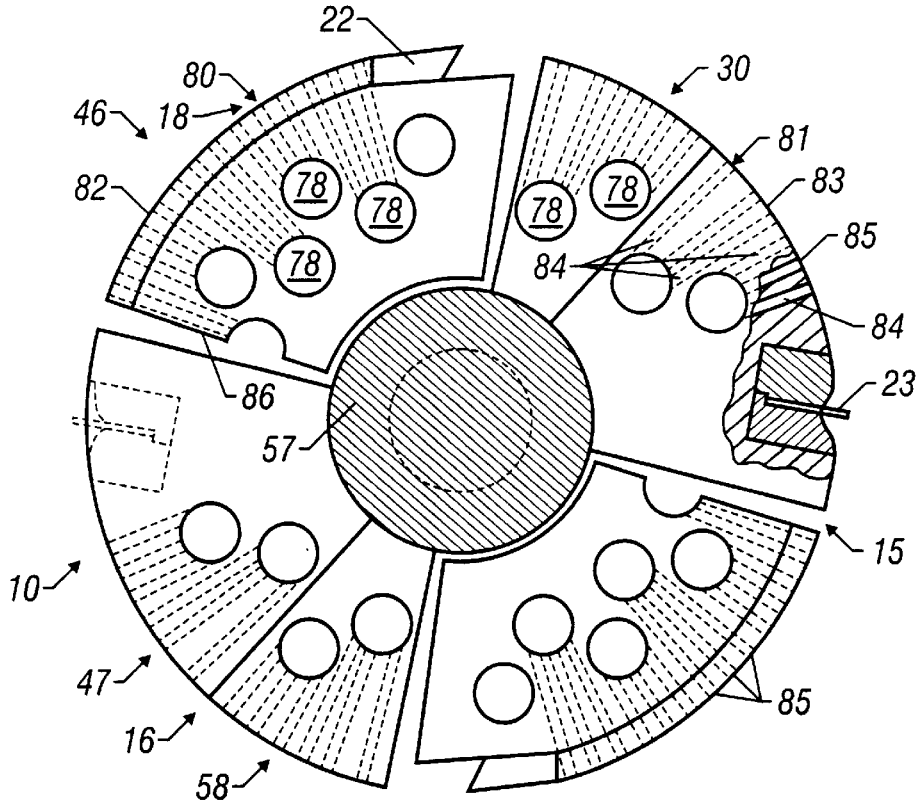
Figure 5:
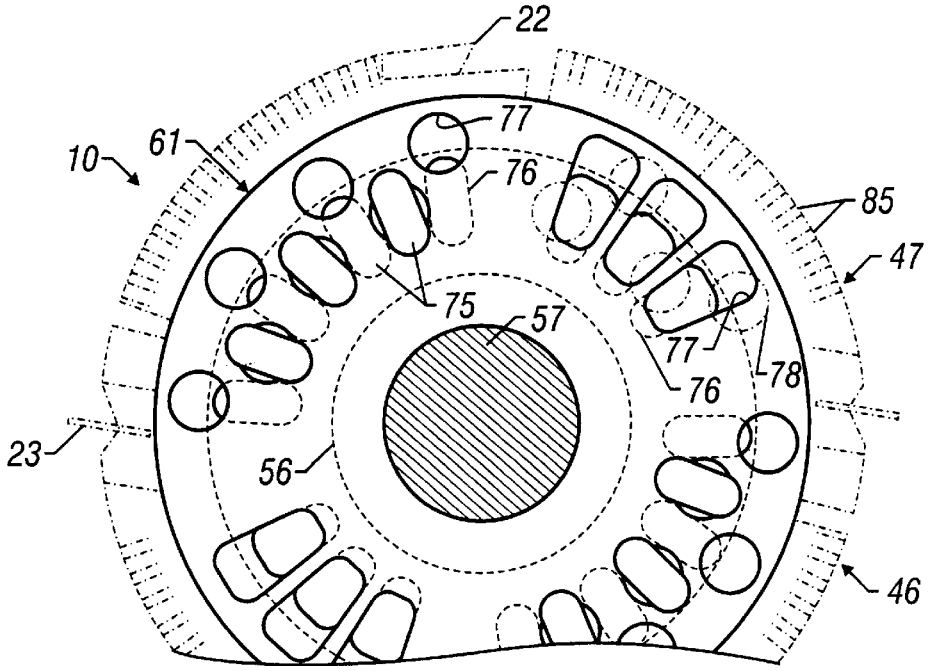
Figure 6:
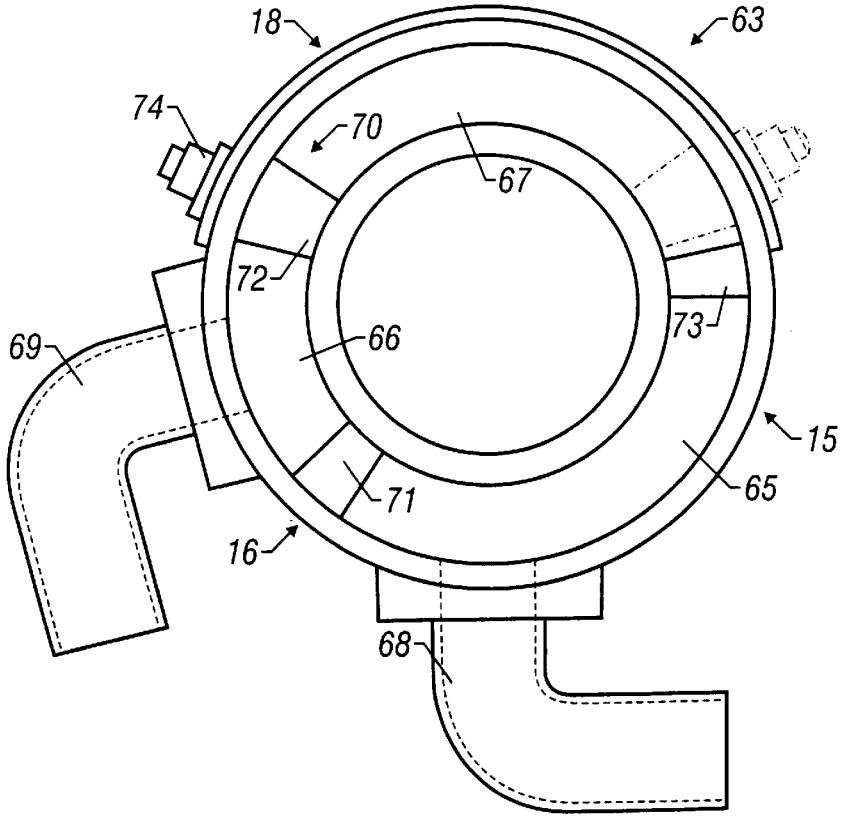
Figure 8:
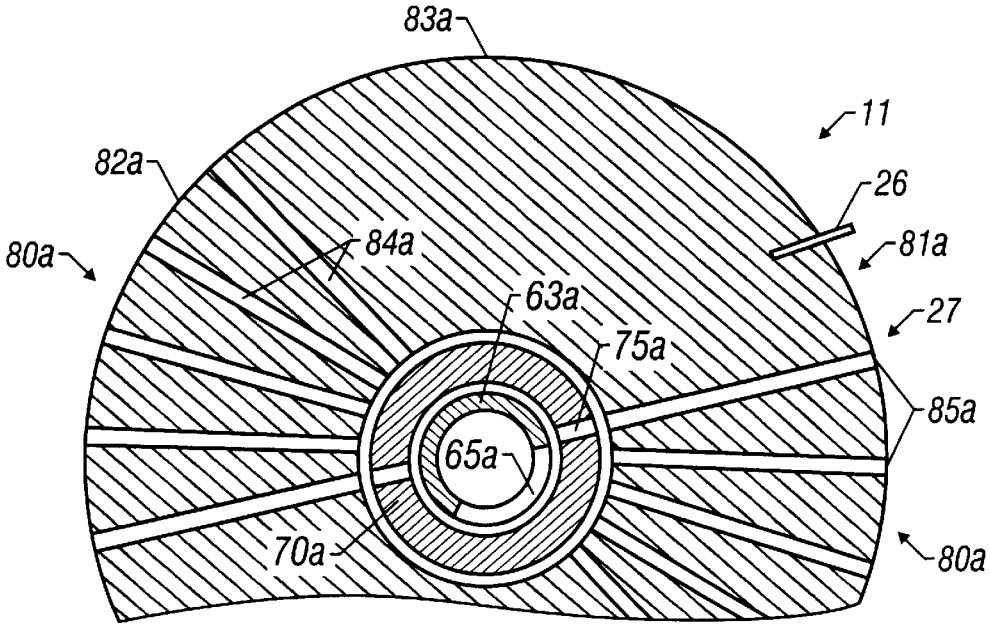
Figure 7:
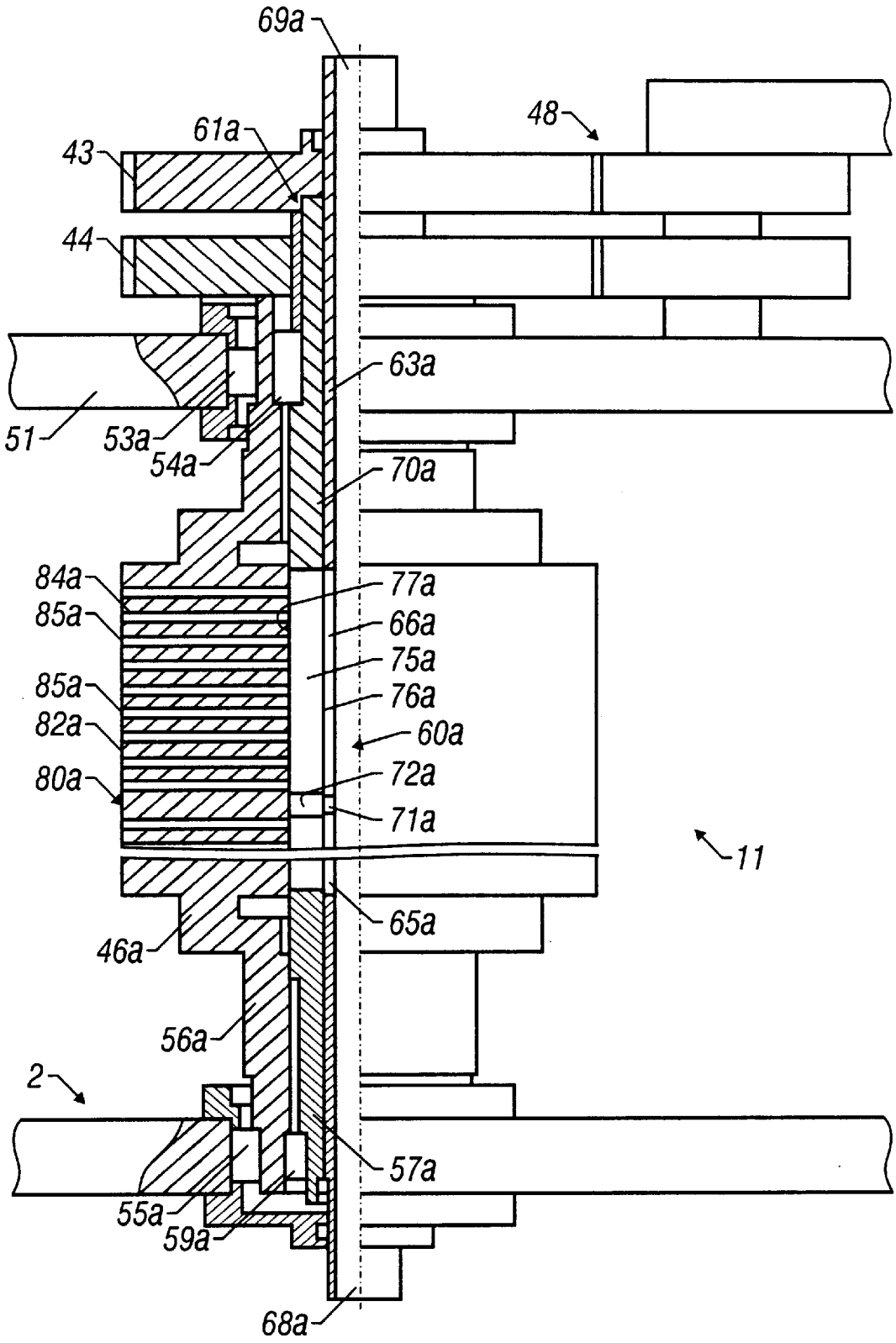
Figure 9:
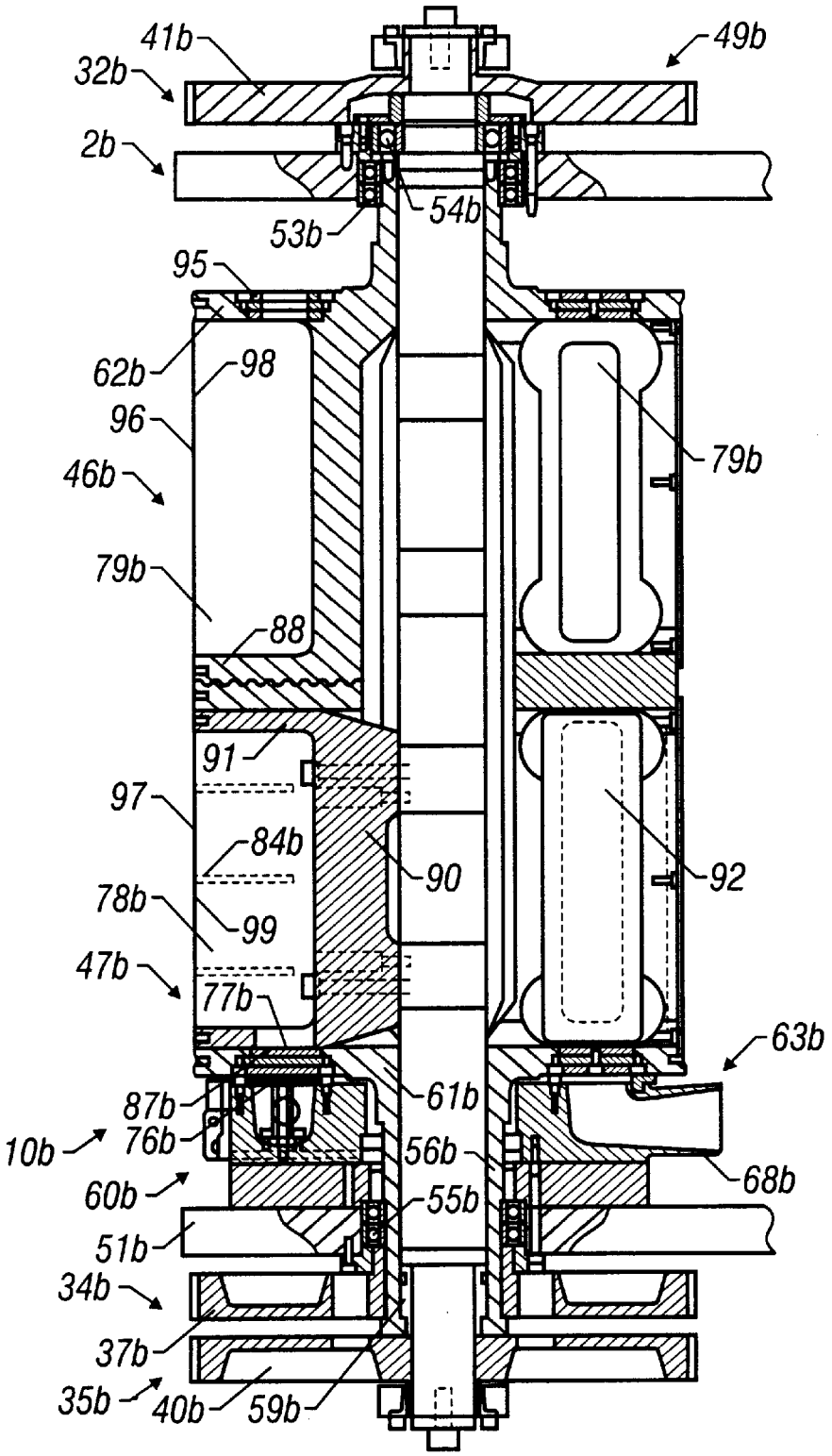
Figure 10:
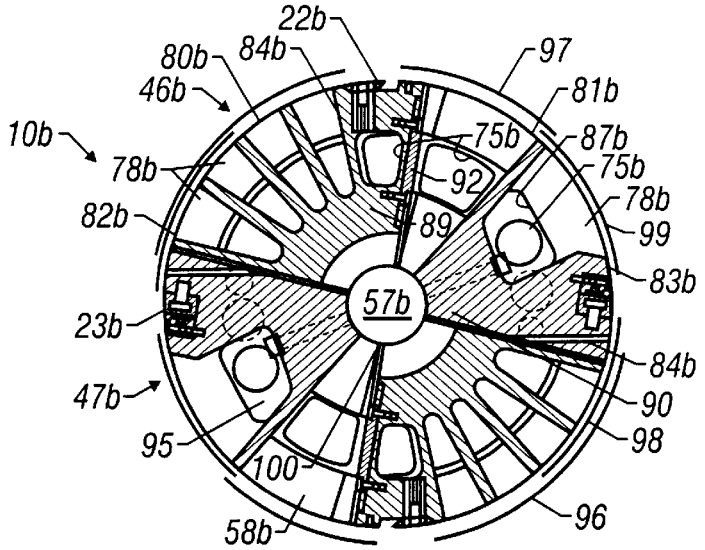
Figure 13:
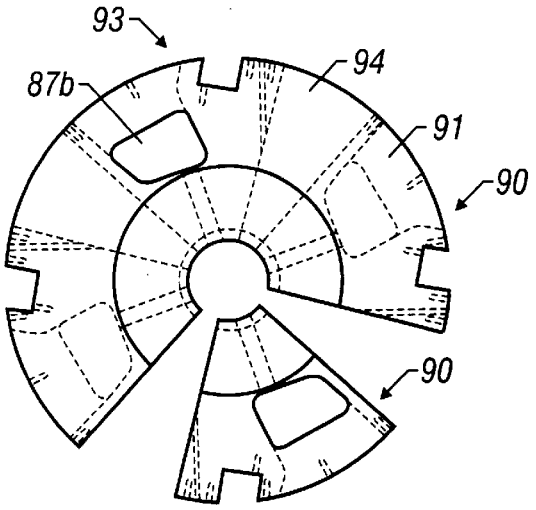
Figure 11:
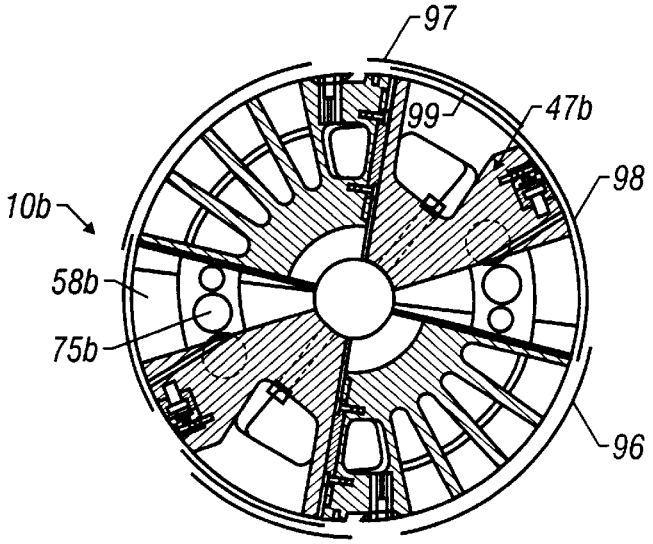
Figure 12:
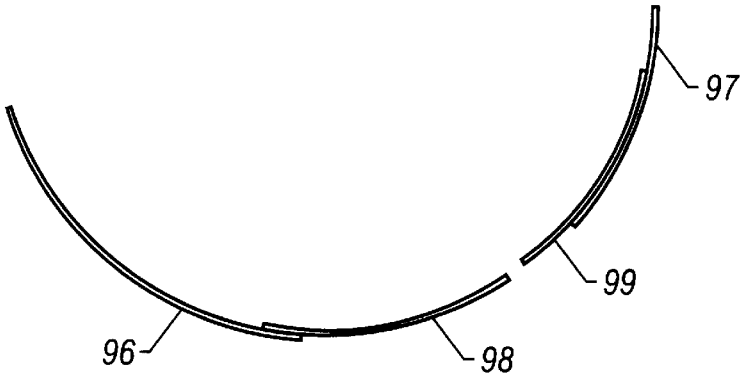
Figure 14:
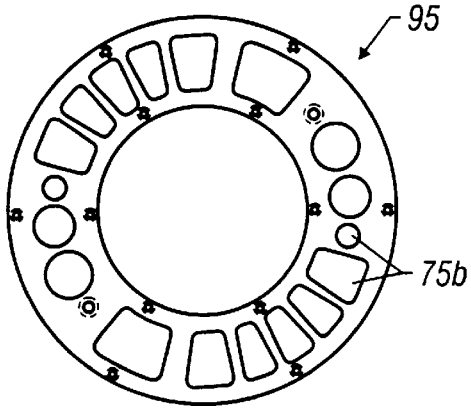
Figure 15:
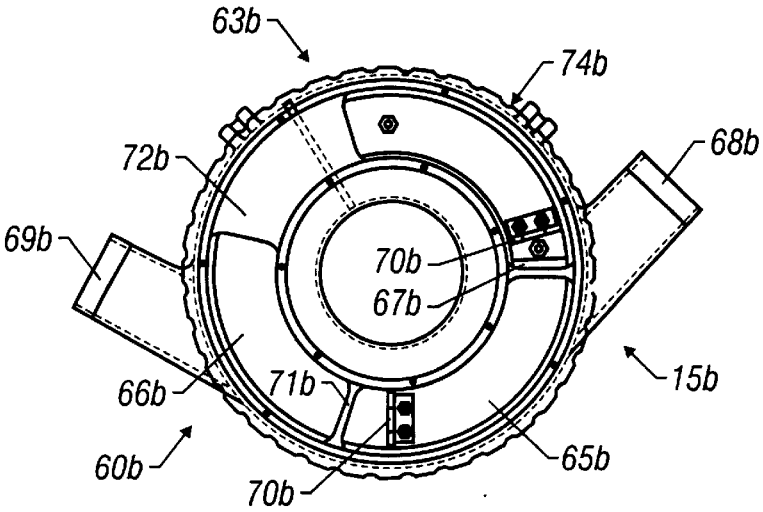
Figure 16:
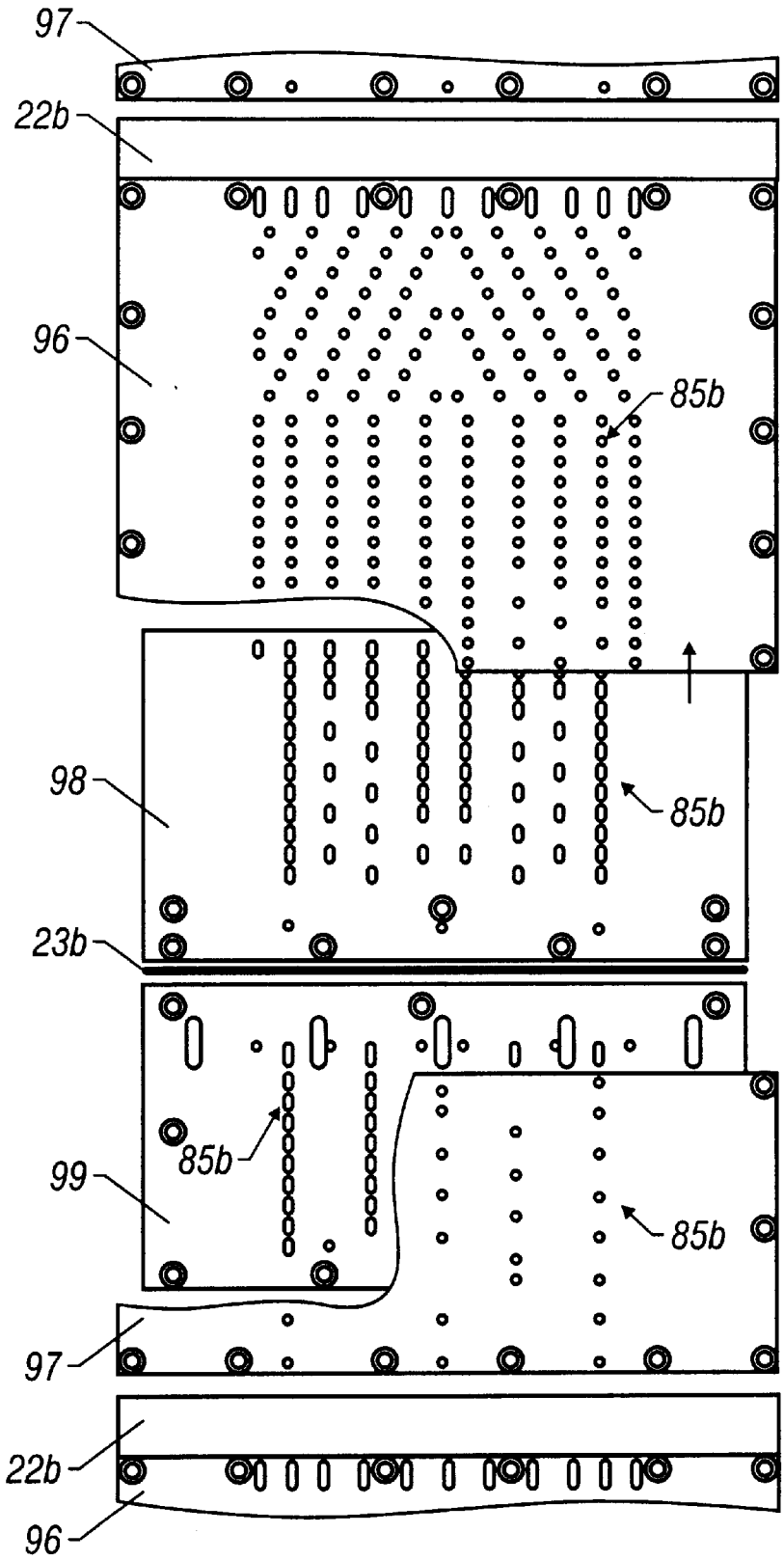

FIG. 1 is a simplified side view of the creaser according to the invention,

FIG. 2 is a layout of the creaser in a view transverse to the material plane, FIG. 3 is a runner according to the invention shown in a partial axial sectional view, FIG. 4 is a cross section of part of the rotor according to FIG. 3, FIG. 5 is an axial view of the fluid connection of a control means controlling the holding force allocated to the rotor according to FIG. 4, FIG. 6 is an axial view of the setting or adjusting means of the control means according to FIG. 5, FIG. 7 is a further rotor shown in accordance with FIG. 3, FIG. 8 is a simplified cross section through the rotor according to FIG. 7, FIG. 9 is another embodiment of the rotor as shown according to FIG. 3, FIG. 10 is a cross section through the rotor according to FIG. 9 in a final adjusting position, FIG. 11 is a presentation of the rotor according to FIG. 10 in the other final position, FIG. 12 are the covering segments of the rotor according to FIG. 10, FIG. 13 is a blank casting for the manufacture of rotor segments, FIG. 14 is a view of a control disk, FIG. 15 is another embodiment of the adjusting means according to FIG. 6, and FIG. 16 is a lay-out view of the covering segments according to FIG. 10 in a view on the support face.

The creaser 1, which is removably and exchangeably arranged on a base console with a support frame 2, serves for applying one or several longitudinal and/or cross creases, and/or folds resulting in creased units 7, 8 which by choice are folded less or more times. In operating direction of the material 5 directly downstream from a longitudinal creaser 3, formed by a creasing funnel, a forward pull drive 4 is arranged, the conveying rotors of which grip the longitudinally creased material web 5 and are driven like essentially all other rotors 10 to 14 of the creaser by a central drive, for instance through a timing shaft.

Directly after the material 5 has been conveyed down past the friction drive 4 it will enter a cutter gap 9, followed by passing optionally over part or all of the provided rotors 10 to 14 and also optionally over intermediate sections into part or all of the stations 15 to 20 and/or mechanisms or passage gaps where the material is subjected to different treatments, followed by being stacked horizontally or vertically in the last station 17 at the outlet of the creaser 1. The material may be optionally provided with one crease only or at least one further crease in a transfer station and/or creaser station 16. For this purpose, the material will pass from the station 16 in sequence to three transfer stations and/or creaser devices 18, 19, 20 and finally to the stacker 17 over the same final route as described above.

Stations 18, 20 may therefore be taken out of operation and are each formed by functional components forming stations 15, 16, whilst device 19 is only formed by components 11, 14. Each individual station 15 to 20 will process and/or treat the material whilst passing continuously through a gap or the like, each limited by two operating rotors 10 to 14.

The web 5 is taken off a storage roll, not shown in detail, along a length compensation dancing roll and a leveller by one of the downstream pull-off conveyors, the conveyor speed of which is controllable irrespective of the drive of stations 15 to 20. The web 5 then passes in sequence a web edge controller, at least one to approximately eight printing stations, a heated drying section, at least one embossing unit and possibly a slitter in which it will be cut without trimming the edges into two or several parallel webs, with each web then being able to pass through the respective longitudinal creaser 3.

In its stored condition, the material 5 may consist of one or several layers having a grammage of 17 to 21 g/m2 per layer. It would be of advantage if the web 5 essentially had a working width corresponding to the working width of each rotor of approximately 500, more than 800 or more than 1000 mm, consisting of a compressed fibrous substrate such as pulp, plastic, tissue or similar. Each web is creased by the longitudinal creaser 3 in longitudinal direction, resulting in legs of equal or different widths, to be passed in this folded condition to the forward drive 4, whilst passing continuously for the above treatments through any stations 15 to 20 which are in operation.

Each station 15, 16, 18, 19, 20 is formed by the interaction of two circumferences and/or support faces of rotors in the most narrow area of the gap and/or the tangential point, the rotors 10, 11, 14 in each case being included in at least two or three stations 15, 16, 18 respective 18, 19 respective 18, 20. At least one of these rotors, for instance rotor 12, may also act at four stations arranged in a distance from each other along its support face, for instance including two transfer points distributed over the rotor's circumference instead of one discharge point, which transfer the units 8 optionally to two separate stacking positions. After leaving each gap zone, the material 5 to 8 is taken along as an entity by the receiving rotor over a curved track of approximately 90°, 180° to approximately 270°, thus being taken over into an oppositely curved track respective motion direction.

In cutter 9 tool 21 operates and material 5 is cut into subsequent blanks 6 by cross cuts from the material web 5 whilst this is nearly completely supported by the external circumference of the respective rotor 10 and with its position being firmly fixed with respect to the same. Each blank 6 may be transferred to the rotor 12 after a curved track of between 90° and 180° in the vicinity of station 16, with the rotor 12 initially seizing the blank 6 between its ends, whereafter its trailing blank leg is delivered essentially by rolling off and without sliding, to the rotor 12, with simultaneously the leading blank leg being drawn from the rotor 10 against running direction of the same and being positioned on the trailing leg, thus forming a unit cross-creased once on the rotor 12, having cross-folded legs of equal or different lengths which are conveyed from the gap of the station 16 over an angle of between 90° and 180° and without processing through station 20 to the stacker 17.

Optionally the blank 6 may also be conveyed up to station 18 from station 16 over a larger curved angle of between 180° and 270° respectively from where it is cross-creased by the rotor 14 as described and conveyed further over the said arc angle by nearly 270° to station 19. In this station, the unit 7 precreased once or several times in cross direction, is transferred to the rotor 11, whilst being precreased, as in station 15, by an internal blade 23 or 26, similar to a line-shaped bulge. Then unit 7 is conveyed from station 19 over a curved angle of approximately 90° to station 20 and cross-creased again in the described way by transfer to rotor 12 and conveyed by the rotor 12 over a smaller curved angle of approximately 90° to the same point on the stacker 17. Unit 8, however, and contrary to the above mode of operation, applies at least one additional cross crease, with a minimum of two or any even number of additional rotors being provided, in order to apply each additional crease, along which rotors the material is conveyed from rotor 10 to rotor 12 over a by-pass path. The working direction of the rotors 10, 12, 13 is identical in both modes of operation, whilst it is opposite for rotors interacting directly at a substantially equal speed.

At least one and up to all rotors 10 to 14 will perform a circumferential and/or rotary motion and may therefore be designed as cylinders or rolls supported by horizontal rotary axes arranged parallel to each other on both sides of the working width on the frame 2. Each rotor may include one or several tools 21 to 30 distributed over its circumference in order to perform any required work in the respective stations. Each of the rotors 10, 11, 12, 14 is designed as a blank-supporting, conveying, receiving and delivering rotor, with rotor 12, 14 on the one hand and 10, 11 on the other essentially having the same functions. Rotor 13 is designed as a cutter rotor, rotor 10 additionally as a counter and precreasing rotor and rotor 12 as a creasing and output rotor.

Rotor pairs 10, 12 and/or 11, 14 on the one hand and 10, 14 and/or 11, 12 on the other are arranged in axial planes oriented approximately parallel to each other or diverging with an acute angle downwardly or oppositely inclined by approximately 45°, with rotors 11, 14 being essentially arranged above the respective associated rotor 12, 10. During each full revolution, the respective rotor may perform one or two or more analogous processings on a respective number of units 6 to 8, depending on how large its effective circumference is. Rotors 10, 11, 13, 14 have the same effective circumferences and each has two analogously operating tool arrangements 21 to 28, offset by approximately 180° in relation to each other. The rotor 12 with a circumference larger by half includes three tool arrangements 28, 29 offset by approximately 120°.

The rotor 13 is arranged on the side of rotor 10, facing away from rotors 11, 12, 10, 14, and will not take over the entire material 5 on its circumference. Two cutters 21 are arranged on its circumference, cutting the blanks 6 from the web 5 to variable lengths in continuous operation and sequence by the counter cutters 22 arranged on the circumference of rotor 10 within the area of the gap 9, with the circumference of rotor 10, 11, 12, 14 forming the support face for the material 5 to 8 which is covering the same over a large area.

Each of these rotors includes a holding or contact means 25, 27, 29, 30 in order to secure the material in position, applying tension in cross direction to the support face over an extended surface and/or approximately parallel to the support face only in the front edge area loading in working direction, with the trailing section of the material being drawn behind without any direct parallel securing of the web. The rotor 10 includes securing and/or contact means 30 essentially extending over its entire circumference and/or its working width, by which the leading end of the web 5 and the blank 6 are rigidly supported from onwards the gap 9 and therefore prior to being cut, over the major proportion of the material surface. This results in good lateral guiding of the web 5 under longitudinal stress at the gap 9 and onwards. Two internal creasers 23, such as folding blades, folding rods or similar, are arranged at circumferential distances from the cutters 22 on the rotor 10. Prior to being cut from the web 5 and whilst passing through the gap 9, each blank 6 is positioned over a folding blade 23 by its side facing the rotor 10, thus applying a bead-shaped, projecting precrease on the other side, which is used optionally in the area of the gap 16 or the gap 18 or over part of the circumference of the rotor 12 or 14 in order to complete the folding. Rotors 11, 14 are interacting accordingly during precreasing and rotors 11, 12 for completing the crease in the area of the gap 19, 20. The tools 24, 25 or 28, 29 of the rotors 12, 14 are therefore essentially identical in their functions and/or design. The tools 24, 28 are forming external creasers or precrease and finished crease receptions whilst the contact means 25, 29 are securing the material in position at the crease engaging inside the reception 24, 28 with its inwardly angled sections. These means provide grippers varied in position in relation to the respective rotor 12, 14, i.e. so called creasing lugs, retaining the material by clamping it with friction only, but so securely that it cannot perform any relative movement in working direction and sideways in relation to the rotor prior to discharge, which movement would require release of the clamping pressure. The rotors 10, 12, 13 and/or 11, 14 and their bearings are each arranged in the same distance from each other in any operating position. The widths of the gap 18, 20 may however, be enlargeable by common radial removal of the rotors 11, 14 with a separate support frame in order to apply the crease only within the area of the gap 16. For this purpose, too, the rotors 11, 14 may be stopped by disconnecting their drives. In order to prevent damaging the projecting tools 23, 26 when passing the rotors 12 to 14, these include recesses or gap-type areas 31 on their circumference in which the tools 23, 26 may engage, for instance whilst forming a precrease, with the respective gap 31 also having the effect of a tool and/or an external blade.

According to FIG. 2, the rotors 10 to 14 are driven in four separate parallel drive planes 32 to 35 in which gears engaging each other or working rotors 36 to 45 are arranged. Depending on the passage of the material 5 to 8, driving power is transmitted from one rotor 13, 10, 14, 11, 12 or 13, 10, 12 to the next, with all rotors being synchronised to and driven by approximately the same circumferential speed. A rotor 36 provided on the shaft of rotor 13 is driving via a rotor 37 directly a first rotor body 46 of rotor 10, as well as a second rotor body 47, firmly connected to the rotor 40, via intermediate rotors 38, 39 of a phase adjusting means 50, such as that of a double planetary gear. This allows adjustment of the tools 22, 23 in relation to each other around the axis of the rotor 10, for relative changes in the leg length of units 6, 7 during operation, on which axis the rotors 37, 40 are arranged, too. The total length of the blank 6 may be modified by adjusting the transmission ratio between respective rotors or by the fact that the gears are replaced like change gears. A rotor 40 rigidly connected to the rotor 41 will drive the rotor 14 through a rotor 42 arranged on the shaft of rotor 14.

correspondingly rotor 42 will drive a rotor 45. Thereby rotor 42 drives through a rotor 43 and this rotor 43 with a rotor 44 drives rotor 45 via an adjusting means 48 corresponding to gear 50. Rotor 45 is firmly arranged on the shaft of the rotor 12. As described, the relative leg length of the unit 7, 8 may also be varied by the adjusting means 48 during subsequent creasing. The rotors 10, 41 may optionally drive the rotor 14 or the rotor 12, depending on the mode of operation, through a change clutch 49. For this purpose the rotors 42, 45 are provided on separate drive planes 32, 33 directly adjacent to each other, with the rotor 41 optionally being in and out of engagement with the rotors 42, 45 due to axial displacement, thus stopping the rotors 11, 14 and/or the adjusting means 48. A respective clutch, which may be radially disconnectable, may be provided between the rotors 44, 45.

The frame 2 is essentially formed by two frame flanks 51 arranged on both sides of the rotor 10 to 14, to support the rotor bearings, with two drive levels 32, 35 provided on opposite outer ends of the same. Rotors 44, 45 are provided in the first, rotors 42, 43 on a directly adjacent second level, rotors 36, 38 at the other end of the frame on the third level and rotors 39, 40 on a directly adjacent fourth drive level.

The stacker 17, designed as a stacker table, is constructed for stacking the units 7 and/or 8 in a horizontal row end to end on their last crease edge without requiring adjustment of the stacker 17 to the two modes of operation. A transfer link 52, such as a upright beater extending upwards, will similarly guide the units 7, 8 from the circumference of the rotor to the rear end of the stacked row in both modes of operation. The link 52 may include several beater arms, freely extending outwardly and pivotally driven, engaging in circumferential grooves of the rotor 12, lifting externally during radial movement, in relation to the rotor 12, each unit 7, 8, whilst the tool 23 is released from the circumference of the rotor 12 to position them on the stacker 17. Suitable circumferential grooves may also be provided in the rotor. The rotor 12 may furthermore interact with two rotatable rotors, forming with the same a transfer gap at the bottom edge facing away from the rotors 10, 11, 14 and a contact means of the described type. These rotors arranged on the same level and driven respectively will then transfer the units 7, 8 by means of nearly horizontal transfer links alternatively to the stack below in horizontal position. These stacks may be conveyed independent from each other.

The rotor bodies 46, 47 of the rotor arrangement 10 according to FIG. 1 to 6 include two bearings 53, 54 and/or 55, 59 on each side of the frame, directly supported and essentially independently from each other directly opposite the flanks 51. The rotor means 46 is supported at the flanks 51 by two external shafts 56 provided on both its front ends and includes, as the rotor means 47 and the external shafts 56, an internal shaft 57, supported directly, radially and axially by the flank 51, being part of drive level 32, 33, irrespective of the support 53 of the external shaft 56, by a bearing 54. Accordingly, the support could also be arranged on the other side and/or on the flank 51, but with the shaft 57 and the bearing 59 being directly supported by the shaft 56 within the area of drive level 34 and/or 35 in this case.

The front end of the rotor means 46 is axially and radially rigidly flanged to one or both shafts 56 and/or designed as an integral part and may be rotated in relation to the shaft 57, whilst the rotor means 47 is sealed at its front end and is engaged in a radially uncentered manner, adjustable after disengagementfter from the shafts 56 and connected directly and firmly with and/or centred to the shaft 57. The rotor means 46 therefore forms the only rigid connection between the shafts 56 by two diametrically opposite axial segments forming a separate assembly, with only the shaft 56 being directly driven by the rotor 37.

The suitably segmented rotor means 47 is rigidly and exchangeable connected to a central, extended section of the shaft 57 provided between the shafts 56, supporting the rotors 40, 41 at either end. The shafts 56 are each supporting at their ends facing the rotor bodies 46, 47, integrally moulded, annular disk-shaped control means 61, 62 between which the rotor segments 46 are gripped in an exchangeable manner and which are components of a control or setting means 60 for varying or setting the contact pressure of the contact means 30 to dependent from the rotational position, from a random setting and the axial zone of the contact means 30.

A controller 63, 64 is arranged on the external face of each control bodies 61, 62, being slideable arranged on one face and firmly attached to the frame and/or adjustable in working direction, surrounding the respective shaft 56 and/or 57 between the control bodies 61, 62 and the respective flank 51 on the circumference. The controllers 63, 64 are independently adjustable and independently supported by bearings 54 to 55 on the frame 2. Each of the two, such as the control bodies 61, 62, which are designed structurally and functionally identical or different and/or arranged mirror-inverted on the controllers 63, 64 positioned opposite each other, include an annular recess in their face directed towards their control bodies 61, 62 extending around the rotary axis in working direction and open towards its front, which may be sealed by radial friction seals against the front of the control bodies 61, 62, positioned on the inside and/or outside.

According to FIG. 6, the annular recess is divided into several annular segment-shaped chambers 65 to 67, separated by each other by a pressure-proof seal, arranged sequentially in working direction, two or more of which are connected to separate fluid and/or control ports 68, 69, with one and/or several not having such a control port. The curved angle over which each chamber 66, 67 extends, may be varied by an adjusting means 70 in relation to at least one or two chambers 65 to 67 even during operation. The chambers 65 to 67 are each sealed in relation to each other by one separating wall 71 to 73, arranged between them and separately inserted and sliding over the respective control bodies 61, 62, which are much smaller than the chambers and exchangeable and/or displaceable in circumferential direction as radial bulkheads, with the bulkhead 72, arranged between the chambers 66, 67, being part of control means 70, which is manually and infinitely variable by the control means 74, being freely accessible and provided on the external circumference of the adjusting means 63 between the bulkheads 71, 73 and which can be fixed in any position. The chambers 66, 67 therefore always extend to the same degree in working direction, as enlargement of the chamber 66 would cause a reduction in the chamber 67 which may be completely eliminated when the bulkheads 72, 73 are positioned against each other.

Different pressure conditions may exist in the chambers 65, 66 through the ports 68, 69. It is furthermore conceivable that both chambers 65, 66 have only one port, with an adjustable damper, an intermediate connection having to be provided between these and the bottom intermediate circuit of a controller.

As shown in FIG. 5, the respective control bodies 61, 62 is provided with identical and unidentical connecting ducts 75 distributed evenly and unevenly around its axis in working direction, forming on its external face outlets and/or inlets 76 for the chambers 65 to 67 and inlets and/or outlets 77 on its internal face for the ends of the main ducts 78, 79 of the rotor bodies 46, 47. The apertures 77 may be offset radially to the outside in relation to respective apertures and apertures 76, 77 may be both circular and also nearly square and/or elongated in shape in radial direction.

Each rotor segment 46, 47, which may be enlarged and/or reduced by adding or removing at least one additional segment 58, which is rigidly connected to it in working direction, including, as this one, ducts 78,79 as the main ducts, provided approximately in lateral direction of the rotor 10 and nearly parallel with its axis to the same in two or more different spacings from the area of the circumference and/or in respective rings around the rotary axis. Two or several main ducts 78, 79, each extending only over approximately the same portion of the working width, with the main ducts 78, 79 aligned to each other, being formed by closely adjacent blind holes extending adjacent to each other or being separated and pressure-sealed by a separating means adjustable in order to change the length of each duct 78, 79. The circumferential area of each rotor segment 46, 47, 58 is forming a support face 82, 83 for the material 5, 6 and within the range of this support face a contact area 80, 81 for pressing the material down, irrespective of its weight. Each contact area 80, 81 is formed by a multitude of inlets. 85, spread in a minute grid over the support face 82, 83, which may contain, for instance, in at least two or three actual rows arranged in sequence in circumferential direction, inlets 85, evenly offset against each other in axial direction. This can be achieved by providing several branch ducts 84 from the section of each duct 78, 79, which are offset at an angle around its central axis, the outer ends of which are spread over the support faces 82, 83, thus forming one inlet 85 each. The curved angle over which the inlets 85 of the respective ducts 78, 79 are extending around the rotary axis is essentially smaller than that of the chambers 65 to 67, amounting only to approximately 10° minimum or maximum, allowing very accurate control of layer-specific contact pressures and/or an extension of the contact section.

Inlets and/or contact sections may also be provided in the area of the tools, in particular the cutters 22, extending nearly to their blades, with their breast area being provided with inlet ports. Furthermore, at least one flank area 86 of each rotor segment 46, 47, 58, being provided approximately on the same axial level with the rotor 10, may be provided with a duct 78, 79, 84 only limited by part of its circumference, whose remaining section is then to be sealed by the respective partial duct of an additional segment 58, allowing the inlets 85 not only to extend to this flank, but also being provided in the separating gap between the said rotor segments. No contact areas are provided in a small area of the circumference in this case in working direction on both sides of the tools 23, due to the fact that the tools 23 are used for lifting the material 5, 6 from the support face 82, 83.

The tools 22, 23 are each positioned in working direction on or in close proximity of the front end of the respective rotor segment 46, 47 which may be free from inlets in working direction upstream from the tools 22, 23. The inlets 85, however, are extending to each rear end of the segments 46, 47 and to the two flank ends of the segment 58. The end of each duct 78, 79 in the respective face of the segmental bodies 46, 47 is forming a connecting port 87 for the respective aperture 77, with the port 87 of the rotor means 46 possibly being congruent with the apertures 77 in position, whilst port 87 of the rotor means 47 being possibly connected to one or two adjacent apertures 77 by overlapping, depending on their adjustment. A separate aperture 77 is provided for each port 87 and/or for each ring of ports of the rotor means 46, whilst the aperture 77 for both rings of ports 87 of the rotor means 47 are jointly provided, with two radially offset ports 87 each being possibly connected to the same aperture 77 and/or to separate apertures 77. Owing to the fact that the inlets of the ducts 78,79 are only extending over part of the working width of the support faces 82, 83 and a separate controller 63, 64 is provided for each of these sections, separate contact areas, directly connected to each other and/or arranged at a distance from each other are provided over the working width over which varying contact pressures may be exerted.

Exchangeable insertion of at least one closing means into at least one connecting duct and/or one aperture 77 allows the control and/or complete sealing of individual ducts 78, 79 and/or respective inlets 85 and/or independent control of axial line-shaped sections of the said contact areas 80, 81 over a respective section of the working width.

Stations 15, 16, 18 are marked by arrows in FIGS. 4 and 6.

Some degrees prior to the support face 82, 83 reaching station 15 and the web 5, the respective contact area 80, 81 will be connected to the chamber 65, thus exerting its maximum contact pressure through the port 68. This contact pressure will remain intact until the contact section has reached station 16 in which the contact pressure is cancelled in an area free from the separating bodies 71 and/or of contact points 85 of tool 23, allowing the rotor to take over the blank 6, for instance by the contact means 29, on the precrease or not, irrespective of whether the blank 6 has already been separated from the web 5 in station 15. During this separation, the material 5, 6 is secured on both sides directly adjacent to the point of separation by the contact areas 80, 81. The leg of the blank 6 downstream from the precrease will be secured on transfer into station 16 until reaching the same, by the said contact pressure, whilst the upstream leg will be secured by a lower contact pressure in comparison to the same, due to contact areas 80, 81 which are securing it, now communicating with the chamber 66, causing a sudden reduction in contact pressure to a lower level. The leading material leg may therefore be withdrawn against working direction of the rotor 10 from the support face 83 and laid on the trailing leg, which is being transferred essentially by rolling off in cross direction to the support face 82 to the respective circumferential support face of the rotor 12.

Depending on the setting of the adjusting means 70, contact pressure will once again be suddenly reduced and/or cancelled in or downstream from station 18, allowing transfer of the blank 6 in a suitable way to the support face of the rotor 14. In this case the separating bodies 72 will have the same effect as the separating bodies 71. When adjusting this separating bodies 72, a position may be selected in relation to station 18, up to which contact pressures will be effective and/or from where it will be considerably reduced at least for the leading material leg or cancelled within the area of the chamber 67. The chamber 66 applying the said effects may also follow the dual separating bodies 72, 73 in working direction, directly after the chamber 65, with positive contact pressures being applied nearly over the entire rotation. The said contact areas 65 to 67 are independently adjustable over the working width by the controllers 63, 64.

Furthermore, the area extensions of the contact sections may be adjusted in working direction and in the direction of the working width both by the controllers 63, 64 and by removing and/or adding additional segments 58 of varying sizes to the flank of the segmental bodies 46, 47 facing away from the tool 22 and/or 23, and provided opposite to working direction. This will furthermore allow a change in position of the contact areas 80, 81 in comparison to the rotor bodies 46, 47.

Identical drawing references have been used in FIGS. 1 to 16 but including "a" suffixes for FIGS. 7 and 8 and "b" suffixes for FIGS. 9 to 16, with all sections of the specification applying respectively to all embodiments.

With reference to the rotor 10, two active contact areas 80, 81 around the rotary axis are simultaneously extending to the same unit 6, acting on both sides of the tool 23, over a curved angle of more than 45° to 160°, with each end of the unit 6 being drawn against the support face 82, 83 and/or with essentially evenly distributed, positive contact pressures being applied between these ends. The curved angle of the contact section 80 may be of approximately the same size as that of the contact area 81, and between interacting contact areas 80, 81, a section essentially free from positive contact pressures may be provided, extending on both sides of the tool 23 and having a curved angle of less than those of individual contact areas 80, 81. The curved angle of each contact section 80*a* of the rotor 11, too, is larger than 40° and/or 60°, with at least four to eight or twelve cross rows of inlets 85 being provided in working direction, arranged end to end, having essentially the same spacing from each other. The curved angle of the support face 83*a* being free from positive contact pressures, of a minimum of 90° to 110° is therefore larger in comparison, with this support face 83*a* having multiple extensions downstream from the tool 26 and not upstream of the same, i.e. being at least four times longer in working direction.

Essentially within the working width of the support faces 82*a*, 83*a* a sleeve-shaped adjusting means 70*a* of the controller 60*a* is arranged within the rotor means 46*a* and/or the rotary axis, including a longitudinal slot, being a connecting duct 75*a* for each section of the working width. This longitudinal slot is forming the port 76*a* on the internal circumference and the aperture 77*a* on the external circumference to which the radial internal ends of the branch ducts 84*a* are immediately adjacent. The slot widths of the axial slot 75*a*, however, have been kept so small that a contact section of less than 15° or 10° and/or approximately 5° of a curved angle is available on the support face 82*a*, but with inlets 85*a* also provided end to end in working direction in the same, for instance allocated to four adjacent cross rows. All other branch ducts 84*a* are sealed by the circumference of the adjusting means 70*a*.

The aperture 77*a* may be adjusted by the adjusting means 70*a* over the entire range of the respective branch ducts 84*a*, allowing random adjustment of the contact area with a positive effect in and against working direction in relation to the rotor means 46*a*, depending on how far the leg of unit 7 preceding the tool 26 extavailable by tustment is available by the rotor 43 during operation, with the adjusting means 70*a* rotating synchronously with the rotor means 46*a*. One end of the adjusting means 70*a* projecting from the rotor means 46*a* is forming a control sleeve 61*a*, firmly connected to the rotor 43 for this purpose.

Simultaneously this end and the other end are forming an internal shaft 57*a*, supported on its external circumference by the bearings 54*a*, 59*a*, over the internal circumference of the external shaft 56*a* of the rotor means 46*a*. The external shaft 56*a* as such is supported approximately on the level of the bearings 54*a*, 59*a* by the bearings 53*a*, 55*a* on the flanks 51 and is rigidly connected to the rotor. For reciprocal adjustment of the two rotors 43, 44 an adjusting means 48 is used.

Within the rotor means 46*a* and the adjusting means 70*a*, a rotary axis is provided in a tubular adjusting means or unit 63*a*, the sleeve of which includes continuous passages 65*a*, 66*a*, extending over a curved angle corresponding approximately to that between stations 19, 20 or being larger than the same. In correlation with the connecting ducts 75*a*, a rotary slide control results in such a way that when a unit 7 arrives at the station 19, the leading creased end of unit 7 is taken by the respective area of contact section 80*a* and attracted over the said small curved angle, conveyed in this condition in working direction, followed by being released from the contact pressure within the area of station 20 by closing the line connection between the connecting ducts 75*a* and the control port 65*a*. This line connection will only be reopened when station 19 is reached.

The two ends of the adjusting means 63 are used as ports 68*a*, 69*a* as a vacuum source, with the connecting duct 75*a* and the control port 65*a*, 66*a* each being divided by a bulkhead 72*a* and/or 71*a* and/or being able to form sections separated from each other, with varying, highly surface-specific contact pressures being applied in respective sections over the working width. The adjusting means 63*a* is infinitely variable in relation to the position of the control port 65*a*, 66*a* around the rotary axis in relation to the frame 2 even during operation, thus acting as a baffle. The extension of its baffle aperture 65*a* in working direction may also be varied in a simple way, for instance by replacing the adjusting means 63*a*.

The same applies respectively to the adjusting port 75*a* and/or the adjusting means 70*a*. The support faces 82*a*, 83*a* including the contact areas 80*a* and the creasing strips 26 need not be adjustable against each other in this case. Therefore these support faces may be designed as integral parts.

According to FIGS. 9 to 11, the control bodies 61*b*, 62*b* are designed as an integral part of the external shafts 56*b* and the entire sleeve of the rotor means 46*b*, forming an annular disk-shaped central flange 88 in the centre and/or between individual widths of the total working width. The rotor segments 89 of the rotor means 46*b*, provided diametrically opposite each other, are forming a continuous support pocket for a rotor segment 90 of the rotor means 47*b* between one front flange 61*b* and/or 62*b* each and the central flange 88 each extending to the shaft 57*b*, thus providing at least a separate rotor section 90 for each individual working width. The rotor section 90 includes front walls 91 at either end, being sealed and sliding by their outer faces facing away from each other on the internal faces of respective flanges 61*b*, 88, facing each other and limiting between them one main duct 78*b* and/or 79*b* extending approximately from the rear of the support for the tool 23*b* to the rear flank of the rotor segment 90.

The front wall 91 sliding on the control disk 61*b* and/or 62*b*, is provided with a connecting port 87*b* and connected to at least one of the connecting ducts 75*b*. The main ducts 78*b*, 79*b* of the rotor sections 89, 90 are open over their full length and/or up to the respective flanges 61*b*, 88, 62*b* and/or up to the front walls 91 and therefore over the respective working width over the full internal width on the external circumference of the rotor segment 89 and/or 90 due to being designed as pockets and/or groove-shaped recesses with a width decreasing towards the base of the groove. The rotor section 89 is forming a multitude of such adjacent pockets 78*b*, 79*b* behind the support for the tool 22*b*, each separated from each other on axial level by a longitudinal web being thinner in comparison to the pocket width. Each of these main ducts 78*b*, 79*b* is at least conductively connected within the area of the groove base to a narrower connecting duct 75*b* of the respective control disk. Another main duct is arranged radially within the tool 22*b*, with its respective groove opening being arranged in the respective flank of the rotor segment 89 and being sealed by a plate-shaped closing means 92 sunk into the flank at the groove opening. Branch ducts 84*b* extend from this main duct throughout the tool 22*b*, with inlets being formed on the external surfaces of the support face.

Several, in particular all four rotor segments 90, required for the rotor 10*b* may be produced from one blank 93 in accordance with FIG. 13 in the shape of a cast cluster, with all segments 90 being distributed over two frontal levels including spacings between each other and distributed evenly around the axis of the blank. In the blank 93, the front walls 91 are initially extending beyond these spacings, but are singled out as segment-shaped separations 94 between flanks of adjacent segments 90 facing each other, with the rotor segments 90 being singled out, followed by being assembled in the rotor means 46*b* and/or being screw-fastened and exchangeable against the shaft 57*b*. This allows joint and very accurate machining of the front faces facing away from each other, the circumferential faces and the connecting faces for the shaft 57*b* and the tool support of all segments 90. The ports 87*b* are integral parts of the casting and are not machined.

The control means 61*b*, 62*b* include annular recesses adjacent to the groove base of the chamber 78*b*, 79*b* around the rotor axis extending to the internal frontal area of each respective control means 61*b*, 62*b*, only interrupted by flank webs between the pockets 78*b*, 79*b* on the level of the respective internal face area. Annular disk-shaped control inserts 95 are rigidly inserted into these annular ports according to FIG. 14, contacting the edges of the flank webs under pressure and forming the connecting duct 75*b*. Two or more control inserts 95 each may form a jointly pressurised package including congruent connecting ducts 75*b*, which may be so thin than their connecting ducts 75*b* can be very accurately produced by a laser beam. The outermost insert 95 will consequently form the port 76*b* and the innermost insert 95 the aperture 77*b*.

The support faces 82*b*, 83*b* and/or their contact areas 80*b*, 81*b* are formed in this case by shell and/or covering means 96 to 99 shown for clarity's sake in FIGS. 10 and 11, also shown somewhat lifted off the circumference of the rotor bodies 46*b*, 47*b* radially to the outside and forming the entire working surface between subsequent tools 22*b*, 23*b* in working directions. Special covering segments 96 to 99 are provided for axially adjacent single working widths, pairs of which may be of the same design. This also applies to the tools 22*b*, 23*b*. Two covering segments 96, 97 are attached on either side of the tool 22*b* to each rotor segment 89. The covering segment 96 is arranged flush and immediately adjacent to the branch duct 84*b* at the rear of the tool 22*b*, overlapping all respective main ducts 78*b*, 79*b* of the respective rotor section 89, possibly projecting slightly over its rear flank.

The covering segment 96 is attached by exchangeable bolts in axial direction alongside the tool 22*b* and on both side edges up to the rear end of the segment 89 to the circumference of this segment 89, i.e. clamped directly to the circumferential surfaces of the flanges 61*b*, 62*b*, 88. A similar arrangement applies to the covering segment 97 directly adjacent, prior to the tool 22*b*, to its support recess and projecting with the major part of its circumference over the front flank of the segment 89. The covering segments 98, 99, too, are adjacent to the support recess for the tool 23*b* and/or to the recess itself, which are, however, only fixed and clamped in relation to the respective rotor section 90 and are arranged in a sleeve area radially offset to the inside provided around the thickness of the covering segments 96, 97 in such a way that their external faces are in full contact with the internal faces of the covering segments 96, 97 and their internal faces are in lateral contact with the circumferential faces of the flanges 61*b*, 62*b*, 88 within the segments 96, 97 and/or are allowed to slide. Similar to the covering segment 97, the front covering segment 98 is projecting over part of the circumferential section of the adjacent rotor segment 89 over the front flank of the respective segment 90, whilst the rear covering segment 99 only projects slightly over the rear flank area. The flanges 61*b*, 62*b*, 88 do not project over the support faces.

Depending on reciprocal adjustment, a segment gap 58*b* is formed between adjacent rotor segments 89, 90 and/or between their flanks facing each other. The gap 58*b* in front of tool 22*b* and behind tool 23*b* is completely covered by the covering segment 97 and partly covered by covering segment 99 in any setting. The gap 58*b* provided in front of tool 23*b* and behind the tool 22*b* is also completely covered by covering segment 98 and slightly covered by the covering segment 96 in any setting. The underlying covering segments 98, 99 are slightly more narrow than the covering segments 96, 97 allowing them to slide sideways along their external fixing bolts, with the covering segment 98 only being attached to the rear end of the rotor segment 90 and freely projecting from this attachment, but passing through the covering segment 96.

Owing to being covered by the segments 96 to 99, the said gaps are essentially forming an enclosed chamber 58*b* connected to the controller 60*b* in the described way, therefore allowing contact areas to be formed within their area. Branch ducts 84 may also be connected to each chamber 58*b* within the adjacent rotor segment, ending directly prior to the respective tool, i.e. tool 23*b* and being continued through the respective covering segment 98, thus forming another inlet 85*b* in this area. Due to the design of the control insert 95, the chambers 58*b* and/or the said branch ducts 84*b* are always connected through to the controller 60*b* irrespective of their width setting.

In order to seal each chamber 58*b* irrespective of the rather large internal circumference of therotor segments 89 against the external circumference of the shaft 57*b*, seals 100, such as labyrinth seals, are provided. For instance, metal plates or similar arranged on radial and/or axial levels, may be attached to both flanks of the rotor segment 89, the radial internal edges of which are arranged directly adjacent to the external circumference of the shaft 57*b*. A suitable cross seal may also be arranged between adjacent rotor segments 90 within the area of the flange 88 in order to allow axially adjacent chambers 58*b* to be separately pressure-controlled. Separating and/or sealing plates may simultaneously form stops for reciprocally stopping adjacent rotor segments 89, 90, with the chambers 58 b therefore never being completely closed, but forming, at minimum width, a gap of approximately 1 mm thickness. This allows the formation of nearly continuous contact areas over the entire circumference of the rotor, irrespective of any setting of the rotor means 46*b*, 47*b*.

The inlets 85*b* provided in the perforated grid in the covering segments 96 to 99 are designed and/or arranged in such a way that covered inlets 85*b* of the covering segments 98, 99 between the covering segments 96, 98 and/or 97, 98 are provided, partially or completely covered by the inlet 85*b* of the overlapping covering segment 96 and/or 97, thus forming connecting ducts for the latter. For this purpose, the inlets 85*b* of the covering segments 98, 99 are distributed parallel to working direction, extending in longitudinal direction and/or having an elongated hole shape, distributed nearly over the same width of the contact area as the ports of the covering segments 96, 97. The covering segment 98 includes passages directly adjacent to the respective tool 23*b* arranged congruent with the branch ducts 84 located in front of the tool 23*b* and therefore being controlled by these and the respective chamber 58*b*.

The covering segment 96 includes inlet ports in longitudinal rows directly behind tool 22*b*, arranged on either side of the longitudinal central level of the respective single working width in an oblique fashion, thus extending from this longitudinal central level towards the outside. This inlet arrangement is only spread over an area in which the cover segment 96 cannot be overlapped by cover segment 98 in accordance with FIG. 10, with the inlet arrangement, used for spreading the material, always being effective. The material is subjected to external stretching from the centre of its width to both sides by this arrangement of inlets, and is therefore prevented from creasing, irrespective of the reciprocal adjustment of the rotor bodies 46*b*, 47*b*. Reciprocal adjustment of the rotor bodies 46*b*, 47*b* around the rotor axis may be more than 30° or 40° or even 45°. Furthermore, the section of the passage in the inlet perforations may be essentially infinitely varied over its overlapping section, similar to a slide valve, by perforations in the covering segments 96, 98 overlapping each other on the one hand and the covering segments 97, 99 on the other.

FIG. 9 only shows the control units 63*b* of the controller 60*b*, with the other to be arranged in a symmetrical mirror image on the other front side of the rotor means 46*b* in accordance with FIG. 3. In a control unit 63*b* according to FIG. 15, the three bulkheads and/or separating walls 71*b*, 72*b*, 73*b* are integral parts of the control housing and/or the edges of its annular groove, and a variable adjusting means 70*b* is arranged in chambers 65*b*, 67*b* as an additional radial bulkhead. The connection 68*b* is directly attached on both sides to the separating wall 73*b* in both chambers 65*b*, 67*b*, but having a larger inlet section in chamber 65*b*. The two connecting inlet sections in chambers 65*b*, 67*b* may also be varied independently in relation to each other, including their extension into working and/or circumferential direction and therefore the respective extensions of the effective contact areas 81*b*, 80*b* on both sides of the effective area of the station 15*b*. The chamber 67*b* may be nearly closed in this area or alternatively be opened up to the separating wall 72*b*. In a similar way, the chamber 65*b*, too, may essentially be completely closed or open nearly up to the separating wall 71*b*. When the two adjusting means 70*b* are variable by a joined adjusting link, reduction and/or enlargement of the chamber 65*b* will cause respective enlargement and/or reduction of the chamber 67*b*.

Interacting with the control insert 95 and/or its connecting ducts 75*b*, it is recommended that the arrangement is provided in such a way that when the web 5 is shaped like a bead by the creaser blade 23*b* within the area of the station 15*b*, the rear end of the material will be subject to a lower contact vacuum for a short period of time to allow it to be well drawn during this creasing cycle against the respective support face and/or the contact area 81. Immediately after completing this redrawing cycle, the contact pressure will be increased again. This may be effected, for instance, by the inlet sections of the connecting ducts 75*b* shown in FIG. 14, individual ports and/or individual ducts of which, adjacent in circumferential direction, are stepped in circumferential direction. This will prevent the web 5 and/or the blank 6 being drawn obliquely when cut by the tool 22*b* immediately following.

The rotors according to invention may also be fitted into existing creasers at a later date and/or be exchanged against existing rotors in that mechanism, therefore allowing retrofitting.

I claim:

1. A runner for a creaser (1) for creasing sheets made from layer material (5 to 8) to obtain creased units, said runner including a working rotor (10, 11) comprising:

a runner base defining an operating motion including an operating direction and further defining an operating width extension, said runner base including bearing sections for mounting said runner on a machine base (2) of said creaser (1) to perform said operating motion, including first and second base bodies (46, 47). said runner base including first and second mounting points for mounting said runner base on the machine base (2), at at least one of said mounting points said base bodies (46, 47) including first and second bearing sections (56, 57) for separately mounting said first and second base bodies (46, 47) at said individual mounting point to perform said operating motion with respect to the machine base (2), said runner base including support faces (82, 83; 82*a*, 83*a*) for receiving the layer material (5 to 8), said support faces (82, 83; 82*a*, 83*a*) extending substantially parallel to said operating direction, said runner base further including holding means (30, 27) for holding the layer material (5 to 8) against said support faces over a surface extension, said holding means (30, 27) defining holding zones (80, 81; 80*a*, 81*a*) including more than one individual holding zone, said holding zones being juxtaposed along said operating width extension and along said operating direction, for each of said holding zones a common surface unit being defined, over and within said common surface unit said holding zone including at least one holding point defining a positive holding force positively stressing the layer material against said support faces, said holding means (30, 27) being variable with respect to its operating characteristics of zone spacings between said holding zones (80, 81; 80*a*, 81*a*), surface extensions of said holding zones parallel to said operating direction, a relation value between said holding forces per said common surface unit of two of said at least one holding point of each of said individual holding zones and positive holding forces as depending from a circumferential reference spacing between said individual holding zone and a stationary reference base, wherein setting means are provided for varying at least one of said operating characteristics.

2. The runner according to claim 1, wherein for said definition said operating characteristics further include holding locations of said holding zones (80, 81; 80*a*, 81*a*) with respect to said runner base, lateral extensions of said individual holding zones (80, 81; 80*a*, 81*a*) along said operating width extension with respect to said runner base and absolute positive holding forces of said individual holding zones, at least one of said further operating characteristic being variable while said working rotor (10, 11) performs said operating motion.

3. The runner according to claim 2, wherein said working rotor (10, 11) defines work stations lined up in a line along said operating direction, said work stations being substantially stable with respect to said stationary reference base, said work stations functioning in a transfer mode for taking over the layer material (5 to 7) onto said working rotor (10, 11) in a rolling transfer motion, a discharge mode for discharging the layer material (6, 7) away from said working rotor in a rolling discharge motion, a working mode for working of the layer material (5 to 7), a positive holding section for holding the layer material without slipping motion, and a slide holding section for slidingly holding the layer material, at least two of said work stations connecting to each other and providing different said positive holding forces, at least one of said work stations being substantially free from said positive holding forces.

4. The runner according to claim 3, wherein at least one zone end of at least one of said work stations is positionally substantially continuously variable parallel to said operating direction in opposite directions, a phase adjusting means (50) being provided for controlling said holding locations, a setting motion of said phase adjusting means being oriented substantially parallel to said operating motion, a control means (70) being provided for controlling said holding forces of said function zones, in operation of said working rotor (10) said control means providing a diaphragm shutter for a suction current, in said operation said diaphragm shutter being positionally substantially stable but displaceable with respect to said stationary reference base and said machine base (2), said diaphragm shutter including a control port (66, 67; 65*a*, 66*a*) for the suction current, a fluid connection being provided between said control port (66, 67; 65*a*, 66*a*) and said holding zones (80, 81; 80*a*), said fluid connection including fluid ducts (84, 84*a*) penetrating said support faces (82, 83; 82*a*, 83*a*).

5. The runner according to claim 4, wherein said control port (65, 66, 67) extends laterally outside of but adjacent to said support faces (82, 83) and said operating width extension.

6. The runner according to claim 4, wherein in a view on said support faces (82*a*, 83*a*) said control port (65*a*, 66*a*) is extending within said operating width extension, within said common surface unit said fluid ducts multiply penetrating said support faces.

7. The runner according to claim 1, wherein at least one of said positive holding forces is variable as a function of said operating motion, all said characteristics being variable with said setting means.

8. The runner according to claim 1, wherein at least one of said holding zones (80, 81; 80*a*, 81*a*) defines an operating mode of substantially permanent and constant holding force, while in said operating mode at least one of said circumferential reference spacing of said at least one holding zone, and a surface extension of said at least one holding zone being variable.

9. The runner according to claim 1, wherein said holding zones include juxtaposed zones adjacently located along said operation width extension, said holding forces of said common surface units of said juxtaposed zones being differently high, each of said holding zones including a plurality of said holding points.

10. The runner according to claim 1, wherein with said operating motion said working rotor (10) rotates about a central rotor axis, said runner base being assembled from a plurality of base bodies (46, 47) including a first base body (46) and a second base body (47) commonly rotatable about said rotor axis, each of said first and second base body (46, 47) circumferentially including said support faces (82, 83) and further including at least one of said holding means (30), and at least one tool (22, 23) for operationally immersing into the layer material, said first base body (46) being positionally adjustable around said central rotor axis with respect to said second base body (47).

11. The runner according to claim 10, wherein said tool of said first base body (46) includes a cross cutter (22) for transversely separating the sheets from the layer material (5), said holding means (30) of said first base body (46) extending substantially directly up to said cross cutter (22), said tool of said second base body (47) including an internal creaser (23) for engaging a fold inside of the layer material (5) while being creased, said holding means (30) of said second base body (47) extending substantially up to at least one of said internal creaser (23), and said cross cutter (22).

12. The runner according to claim 1, wherein at least one of said reception faces (82*b*, 83*b*) is provided on a covering segment (96 to 99) separate from said runner base (46*b*, 47*b*) but covering said runner base with said reception faces (82*b*, 83*b*).

13. The runner according to claim 12, wherein said runner base (46*b*, 47*b*) includes a gap (58*b*) having a variable gap width extension, said covering segment (96 to 99) directly bridging said gap (58*b*), while said gap width extension is varied, said runner base (46*b*, 47*b*) including at least one tool (22*b*, 23*b*) for deformingly engaging the layer material, with respect to said operating motion said tool (22*b*, 23*b*) defining a leading front side and a trailing back side, said tool defining a machining zone transversely offset with respect to said reception faces (82*b*, 83*b*), said covering segment (96 to 99) connecting directly to at least one of said front side, and said back side of at least one of said tool (22*b*, 23*b*).

14. The runner according to claim 12, wherein said covering segment includes a plurality of covering shells including a first covering shell (96, 98) and a second covering shell (97, 99), said first and second covering shells overlapping each other in a direction parallel to said operating direction and being slideably displaceable with respect to each other, said covering shells including an external covering shell (96, 97) and an internal covering shell (98, 99), said external covering shell (96, 97) having an inner shell face remote from said reception faces and said internal covering shell (98, 99) having an outer shell face opposing said inner shell face, at least one of said external covering shell (96, 97) and said internal covering shell (98, 99) directly supporting against said runner base (46*b*, 47*b*), said external covering shell (96, 97) being connected to said runner base (46*b*, 47*b*) laterally outside of said internal covering shell (98, 99).

15. The runner according to claim 12, wherein said runner base (46*b*, 47*b*) includes a plurality of gaps including first and second gaps (58*b*), said gaps defining gap width extensions parallel to said operating direction, said gap width extensions being variable to define first and second broadest gap width extensions, said covering segment including first and second covering shells (98, 97), said first covering shell (98) being located closer to said runner base (46*b*, 47*b*) than said second covering shell (97), when defining said first broadest gap width extension said first gap (58*b*) being covered by said first covering shell (98), when defining said second broadest gap width extension said second gap (58*b*) being covered with said second covering shell (97) and said first gap (58*b*) being adjusted to define a smallest gap width extension, said first gap being spaced from said second gap in a direction corresponding to said operating direction.

16. The runner according to claim 12, wherein said covering segment (96 to 99) includes said holding means including grid-distributed suction ports (85*b*) for sucking said layer material against said reception faces (82*b*, 83*b*), said covering segment (96 to 99) being made from sheet material.

17. The runner according to claim 1, wherein said runner base includes first and second base bodies (46*b*, 47*b*) commonly laterally opposedly bounding a gap (58*b*), said gap (58*b*) providing a fluid chamber for exposing said reception faces (82*b*, 83*b*) to a fluid current, said reception faces extending over said gap (58*b*).

18. The runner according to claim 1, wherein said runner base includes a gap having a circumferentially variable gap width extension, at least one base segment (58) being provided for being optionally exchangeably immersed into said gap and for being operationally fixedly connected to said runner base, said base segment (58) circumferentially and radially outside extending said support faces (82, 83) and said holding means (30).

19. A runner for a creaser (1) for creasing sheets made from layer material (5 to 8) to obtain creased units, said runner including a working rotor (10, 11) comprising:

a runner base defining an operating motion including an operating direction and further defining an operating width extension, said runner base including bearing sections for mounting said runner on a machine base (2) of said creaser (1) to perform said operating motion, said runner base including first and second base bodies (46, 47), said runner base including first and second mounting points for mounting said runner base on the machine base (2), at least one of said mounting points said base bodies (46, 47) including first and second bearing sections (56, 57) for separately mounting said first and second base bodies (46, 47) at said individual mounting point to perform said operating motion with respect to the machine base (2), said runner base including support faces (82, 83; 82*a*, 83*a*) for receiving the layer material (5 to 8), said support faces (82, 83; 82*a*, 83*a*) extending substantially parallel to said operating direction, said runner base further including holding means (30, 27) for holding the layer material (5 to 8) against said support faces over a surface extension, said holding means (30, 27) defining holding zones (80, 81; 80*a*, 81*a*) including more than one individual holding zone, said holding zones being juxtaposed along said operating width extension and along said operating direction, for each of said holding zones a common surface unit being defined, over and within said common surface unit said holding zone including at least one holding point defining a positive holding force positively stressing the layer material against said support faces, said holding means (30, 27) being variable with respect to its operating characteristics of zone spacings between said holding zones (80, 81; 80*a*, 81*a*), surface extensions of said holding zones parallel to said operating direction, a relation value between said holding forces per said common surface unit of two of said at least one holding point of each of said individual holding zones and positive holding forces above zero as depending from a circumferential reference spacing between said individual holding zone and a stationary reference base, wherein setting means are provided for varying at least one of said operating characteristics.

20. The runner according to claim 19, wherein said bearing sections (56, 57) include bearings (53, 54; 55, 59) for bearing both said base bodies (46, 47), said bearings (53, 54; 55, 59) being axially directly juxtaposed, said base bodies (46, 47) including separate drive members (37, 40) for separately driving said base bodies (46, 47) to commonly perform said operating motion, a phase adjusting means (50) being provided for reciprocally displacing said base bodies (46, 47), said working rotor (10) including an output member (41) for driving an additional runner (12, 14) of said creaser (1).

21. A creaser for creasing sheets made from layer material (5 to 8) to obtain creased units comprising:

a machine base (2);

a working rotor (10, 11) mounted to said machine base (2) for rotation in an operating direction, said working rotor including a holding face (82, 83) and means for holding said layer material (5 to 8) with positive holding forces against said holding face, upon rotation of said working rotor said holding face successively and repeatedly passes by a plurality of operating paths including first and second operating paths, a setting means are provided for varying said positive holding forces when said holding face of said said first operating path to rotation by said second operating path.

22. The creaser according to claim 21, wherein upstream of said first operating path a first folding station (15) is provided and directly connected to said first operating path, downstream of said first operating path said second operating path directly connecting to said first operating path, when said holding face (82, 83) passes said first operating path said positive holding forces being higher than when said holding face passes said second operating path.

23. The creaser according to claim 22, wherein said second operating path connects to said first operating path in the vicinity of a second folding station (16) for folding the layer material, downstream of said second operation path said operation paths including a third operating path directly connecting to said second operating path and said first operating path, while passing said third operating path said holding face being substantially freed from said positive holding forces.

24. The creaser according to claim 21, wherein said at least one working rotor (10 to 14) is a (rotor) rotary cylinder rotating about a single rotor axis with respect to said machine base (2).

25. A creaser for creasing sheets made from layer material (5 to 8) to obtain creased units comprising:

a machine base (2);

at least one workings rotor (10, 11) mounted to said machine base (2) for performing an operating motion in an operating direction, said working rotor including a holding zone (80, 81; 80*a*, 81*a*) for holding said layer material (5 to 8) with positive holding forces above zero, upon said operating motion said holding zone successively and repeatedly passing a plurality of operating paths including juxtaposed first and second operating paths, wherein control means (48, 50, 60) are provided for varying said positive holding forces when said holding zone passes from said first operating path to said second operating path and a second working rotor (12) connecting to separate first and second transfer stations (16, 20) for transferring the layer material (6, 7) onto said second working rotor (12), transfer means being provided for alternately transferring the layer material (6, 7) to said second working rotor (12) at said first transfer station (16) or said second transfer station (20).

26. The creaser according to claim 25, wherein said (runner) second working rotor (12) includes an external creaser (28) for gripping the layer material on a fold outside of a fold to be machined, said external creaser (28) being provided to alternately fold the layer material with a lower number of fold layers and a higher number of fold layers connecting to the fold.

27. The creaser according to claim 25, wherein said operating paths connect to running paths separate from said (runner) second working rotor (12) and provided to convey the layer material, said running paths including a first running path connecting upstream to said (runner) second working rotor (12), said running paths including a second running path including separate first and second subpaths, said first subpath being shorter than said second subpath and being provided to fold the layer material with a lower number of fold layers than when the layer material is directly transferred from said second working rotor (12) to said second subpath.

28. A runner, said runner including a working rotor (10, 11) comprising:

a runner base defining an operating motion and including bearing sections for mounting said runner on a machine base (2) to perform said operating motion, said runner base including support faces (82, 83; 82*a*, 83*a*) for receiving layer material (5 to 8), wherein said runner base includes first and second base bodies (46, 47), said runner base including first and second mounting points for mounting said runner base on the machine base (2), at least at said first mounting point said base bodies (46, 47) including first and second bearing sections (56, 57) for separately mounting said first and second base bodies (46, 47) at said first mounting point to perform said operating motion with respect to the machine base (2), said first bearing section (56) thereby being displaceable with respect to said second bearing section (57) parallel to said operating motion.

29. The runner according to claim 28, wherein said working rotor (10, 11) is a creasing rotor for creasing sheets made from the layer material to obtain creased units, at least one of said first and second base bodies (46, 47) including a creasing tool (22, 23).

30. An apparatus comprising:

a machine base (2);

at least one working rotor (10, 11) mounted to said machine base (2) for performing a rotary operating motion, said working rotor (10, 11) including support faces (82, 83; 82*a*, 83*a*) for receiving the layer material (5 to 8), upon said operating motion said support faces successively and repeatedly passing a plurality of operating paths including juxtaposed first and second operating paths, wherein a second working rotor (12) connects to separate first and second transfer stations (16, 20) for transferring the layer material (6, 7) onto said second working rotor (12), transfer means being provided for alternately transferring the layer material (6, 7) to said second working rotor (12) at said first transfer station (16) or said second transfer station (20).

31. The apparatus according to claim 30, wherein said working rotor (10, 11) is a rotary cylinder.

32. The apparatus according to claim 30, wherein said apparatus is a creaser for creasing sheets made from the layer material to obtain creased units.

* * * * *